US008387784B2

(12) United States Patent
Gonzalez et al.

(10) Patent No.: US 8,387,784 B2
(45) Date of Patent: Mar. 5, 2013

(54) PACKAGE FOR CONTAINERS

(75) Inventors: Ana Gonzalez, Barcelona (ES); Emili Requena, Barcelona (ES); Paul Bradford, Bristol (GB); Andrea Coltri-DePaula, Sao Paulo (BR)

(73) Assignee: Graphic Packaging International, Inc., Marietta, GA (US)

( * ) Notice: Subject to any disclaimer, the term of this patent is extended or adjusted under 35 U.S.C. 154(b) by 79 days.

(21) Appl. No.: 12/834,216

(22) Filed: Jul. 12, 2010

(65) Prior Publication Data

US 2011/0000799 A1 Jan. 6, 2011

Related U.S. Application Data

(63) Continuation-in-part of application No. 12/711,555, filed on Feb. 24, 2010, now Pat. No. 8,096,413.

(60) Provisional application No. 61/224,760, filed on Jul. 10, 2009, provisional application No. 61/208,462, filed on Feb. 24, 2009.

(51) Int. Cl.
*B65D 75/00* (2006.01)

(52) U.S. Cl. ..... 206/153; 206/158; 206/427; 229/103.2; 53/458

(58) Field of Classification Search ..... 229/103.2, 229/103.3; 206/149, 147, 145, 153, 158, 206/151, 199, 197, 434, 152; 53/443, 458
See application file for complete search history.

(56) References Cited

U.S. PATENT DOCUMENTS

| | | | | |
|---|---|---|---|---|
| 1,527,399 | A | | 2/1925 | Davidson |
| 2,289,859 | A | | 7/1942 | Arthur |
| 2,522,950 | A | | 9/1950 | Keith |
| 2,798,603 | A | | 7/1957 | Grinspoon |
| 2,950,041 | A | | 8/1960 | Stone |
| 2,974,851 | A | * | 3/1961 | Struble ..... 229/103.2 |
| 3,137,109 | A | | 6/1964 | Rapata |
| 3,528,697 | A | | 9/1970 | Wood |
| 3,587,847 | A | * | 6/1971 | Graser ..... 206/153 |
| 3,601,439 | A | | 8/1971 | Poupitch |
| 3,627,121 | A | | 12/1971 | Deasy |
| 3,897,873 | A | | 8/1975 | Graser |
| 3,942,631 | A | | 3/1976 | Sutherland et al. |
| 4,029,204 | A | | 6/1977 | Manizza |
| 4,250,991 | A | * | 2/1981 | Manizza et al. ..... 206/158 |
| 4,304,329 | A | | 12/1981 | Graser |
| 4,372,599 | A | | 2/1983 | Kiedaisch et al. |
| 4,378,879 | A | | 4/1983 | Killy |
| 4,382,505 | A | | 5/1983 | Sutherland et al. |
| 4,784,266 | A | | 11/1988 | Chaussadas |
| 5,058,735 | A | * | 10/1991 | Bienaime ..... 206/145 |
| 5,139,147 | A | | 8/1992 | Sutherland |
| 5,188,225 | A | | 2/1993 | Jorba |
| 5,246,113 | A | | 9/1993 | Schuster |
| 5,267,644 | A | | 12/1993 | Tsao |
| 5,297,673 | A | | 3/1994 | Sutherland |
| 5,310,050 | A | | 5/1994 | Sutherland |

(Continued)

FOREIGN PATENT DOCUMENTS

JP 2003-146359 5/2003

OTHER PUBLICATIONS

International Search Report and Written Opinion for PCT/US2010/041661, dated Mar. 1, 2011.

*Primary Examiner* — David Fidei
(74) *Attorney, Agent, or Firm* — Womble Carlyle Sandridge & Rice, LLP

(57) ABSTRACT

A package for holding a plurality of containers. The package has a top panel, end panels and side panels. The package has retention features in the top panel for retaining the containers. The package has handle features in the end panel for forming a handle for grasping and carrying the package.

44 Claims, 19 Drawing Sheets

U.S. PATENT DOCUMENTS 5,310,051 A 5/1994 Sutherland
5,318,178 A 6/1994 Davies et al.
5,323,895 A 6/1994 Sutherland et al.
5,328,024 A 7/1994 Sutherland
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,443,153 A 8/1995 Sutherland
5,445,262 A 8/1995 Sutherland
5,452,799 A 9/1995 Sutherland
5,503,267 A 4/1996 Sutherland
5,520,283 A 5/1996 Sutherland
5,524,756 A 6/1996 Sutherland
5,538,133 A * 7/1996 Campbell et al. ..... 206/427
5,542,536 A * 8/1996 Sutherland ..... 206/427
5,551,566 A 9/1996 Sutherland
5,553,705 A 9/1996 Bakx
5,593,027 A 1/1997 Sutherland
5,706,936 A 1/1998 Bernstein
5,711,419 A 1/1998 Beales et al.
5,746,310 A 5/1998 Slomski
5,791,463 A 8/1998 Negelen
5,816,391 A 10/1998 Harris
5,819,920 A * 10/1998 Sutherland ..... 206/174
5,878,877 A * 3/1999 Sutherland ..... 206/167
5,960,945 A 10/1999 Sutherland
6,039,181 A 3/2000 Whiteside
6,059,099 A 5/2000 Galbierz
6,315,111 B1 11/2001 Sutherland
6,394,272 B1 5/2002 Domansky
6,896,130 B2 5/2005 Theelen
7,011,209 B2 3/2006 Sutherland et al.
7,278,538 B2 * 10/2007 Chargueraud ..... 206/147
2002/0017476 A1 * 2/2002 Le Bras ..... 206/434
2002/0195371 A1 12/2002 Brown
2003/0080004 A1 5/2003 Olsen et al.
2003/0213705 A1 11/2003 Woog
2005/0127151 A1 6/2005 Johnson
2009/0101526 A1 4/2009 Sutherland et al.
2009/0127147 A1 5/2009 Sutherland

* cited by examiner

PACKAGE FOR CONTAINERS

CROSS-REFERENCE TO RELATED APPLICATIONS

This application claims the benefit of U.S. Provisional Application No. 61/224,760, which was filed on Jul. 10, 2009. This application is a continuation-in-part of U.S. patent application Ser. No. 12/711,555, which was filed on Feb. 24, 2010 and claims the benefit of U.S. Provisional Application No. 61/208,462, which was filed on Feb. 24, 2009.

INCORPORATION BY REFERENCE

U.S. Provisional Application No. 61/224,760, which was filed on Jul. 10, 2009, U.S. patent application Ser. No. 12/711,555, which was filed on Feb. 24, 2010, and U.S. Provisional Application No. 61/208,462, which was filed on Feb. 24, 2009, are hereby incorporated by reference for all purposes as if presented herein in their entirety.

BACKGROUND OF THE DISCLOSURE

The present disclosure generally relates to packages or cartons for holding and carrying containers.

SUMMARY OF THE DISCLOSURE

In one aspect of the disclosure, a package is disclosed for holding a plurality of containers, such as, for example, beverage cans. The package has a top panel, an end panel and a side panel. The package has retention features for retaining the containers and handle features for grasping and carrying the package.

In another aspect, the disclosure is directed to a package for holding a plurality of containers comprises panels that extend at least partially around an interior of the package. The panels comprise a top panel, at least one side panel foldably connected to the top panel, and at least one end panel foldably connected to the at least one side panel. At least one feature is in the top panel that receives and holds a top portion of at least one container of the plurality of containers. The at least one feature comprises an opening in the top panel and a retention feature adjacent the opening to engage at least one container of the plurality of containers to at least partially attach the at least one container to the package. The at least one end panel comprises a handle for grasping and carrying the package.

In another aspect, the disclosure is directed to a blank for forming a package for holding a plurality of containers. The blank comprises panels that comprise a top panel, at least one side panel foldably connected to the top panel, and at least one end panel foldably connected to the at least one side panel. The panels are for forming an interior of the package formed from the blank. At least one feature is in the top panel that is for receiving and holding a top portion of at least one container of the plurality of containers in the package formed from the blank. The at least one feature comprises an opening in the top panel and a retention feature adjacent the opening for engaging the at least one container of the plurality of containers to at least partially attach the at least one container to the package. The at least one end panel comprises handle features for forming a handle for grasping and carrying the package formed from the blank.

In another aspect, the disclosure is directed to a method of forming a package for containing a plurality of containers. The method comprises obtaining a blank having a top panel, at least one side panel foldably connected to the top panel, at least one end panel foldably connected to the at least one side panel, at least one feature in the top panel that comprises an opening in the top panel and a retention feature adjacent the opening. The at least one end panel comprises handle features. The method comprises inserting at least a top portion of a container through the opening and engaging the top portion of the container with the retention feature to at least partially attach the container to the package, and forming a handle from the handle features.

Those skilled in the art will better appreciate the above stated aspects and other advantages and benefits of various additional embodiments upon reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure. Thus, limitations of the invention may not be derived from measurements of the drawings.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure generally relates to constructs, sleeves, cartons, or the like, and packages for holding and displaying containers such as jars, bottles, cans, etc. The containers can be used for packaging food and beverage products, for example. The containers can be made from materials suitable in composition for packaging the particular food or beverage item, and the materials include, but are not limited to, aluminum and/or other metals, plastics such as PET, LDPE, LLDPE, HDPE, PP, PS, PVC, EVOH, and Nylon; and the like; glass; or any combination thereof.

Packages according to the present disclosure can accommodate containers of numerous different shapes. For the purpose of illustration and not for the purpose of limiting the scope of the disclosure, the following detailed description describes beverage containers (e.g., generally cylindrical containers such as aluminum cans) at least partially disposed within the package embodiments. In this specification, the terms "lower," "bottom," "upper" and "top" indicate orientations determined in relation to fully erected packages.

Figure 3:
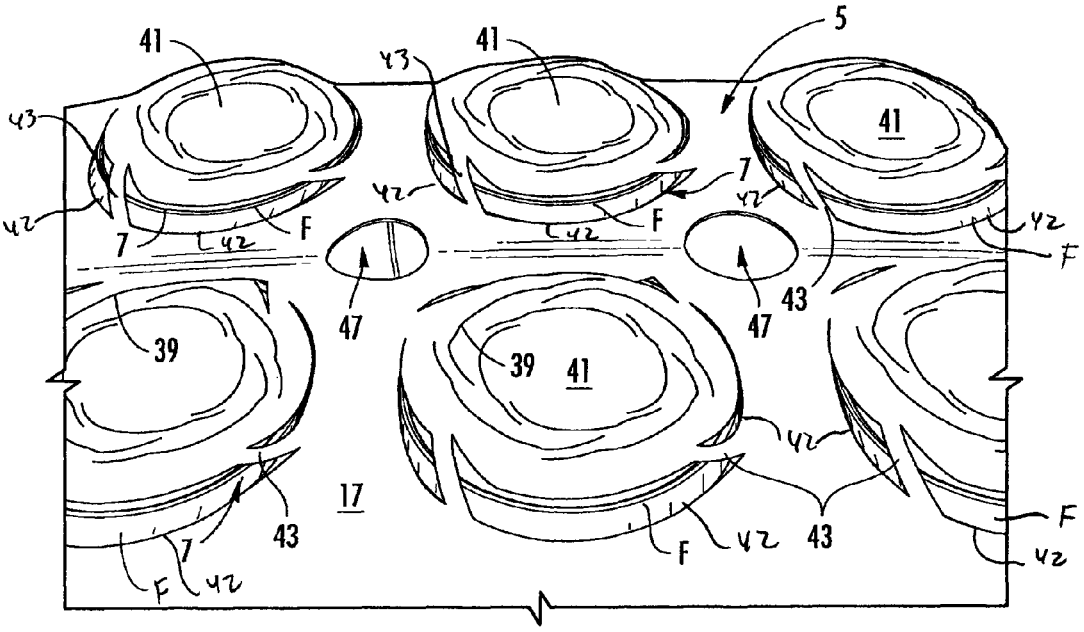
Figure 4:
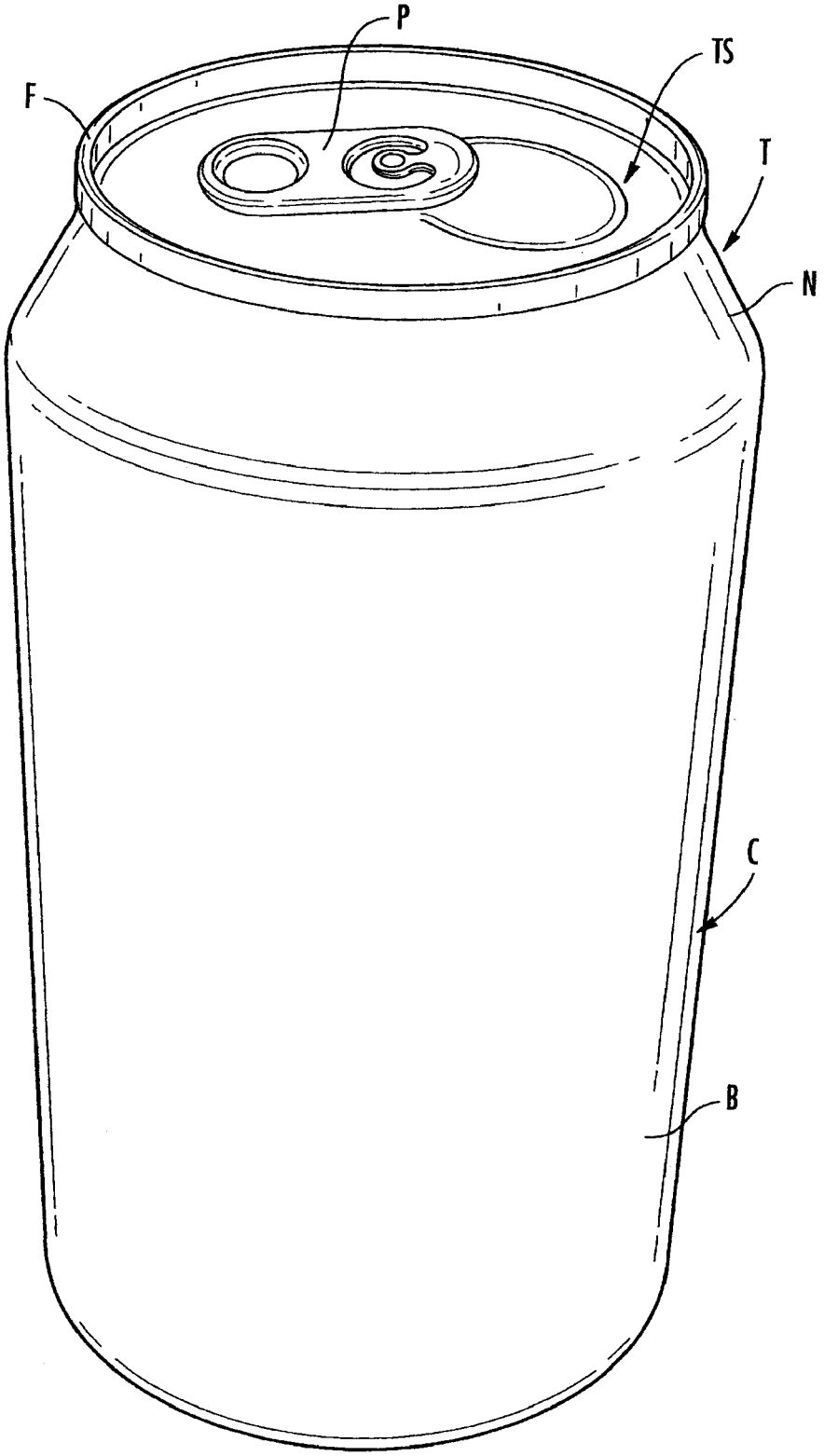

The present embodiments are addressed to cartons or packages for attachment to and accommodation of containers. A package or carrier 5 of a first embodiment is illustrated in its erected state in FIG. 3, in which it is attached to containers C arranged in two rows of three containers. As shown in FIG. 4, the containers C are illustrated as beverage containers having a lower base portion B, a top portion T generally comprising a neck N that tapers inwardly from the lower base portion, a flange portion F at the top of the neck portion that extends radially outward from the neck portion, and a top surface TS below the flange portion that includes a pull-tab P. Containers of other sizes, shapes, and configurations, may be held in the package 5 without departing from the disclosure. The neck N and flange F of the containers C are received in respective openings 7 in the package 5 and retained in the package by retaining features described further herein. The containers C could be arranged in other than a 2×3 arrangement (e.g., 2×4, 2×6, 1×3, 1×4, etc.) and the package 5 could include more or less than six containers without departing from the disclosure.

Figure 1:
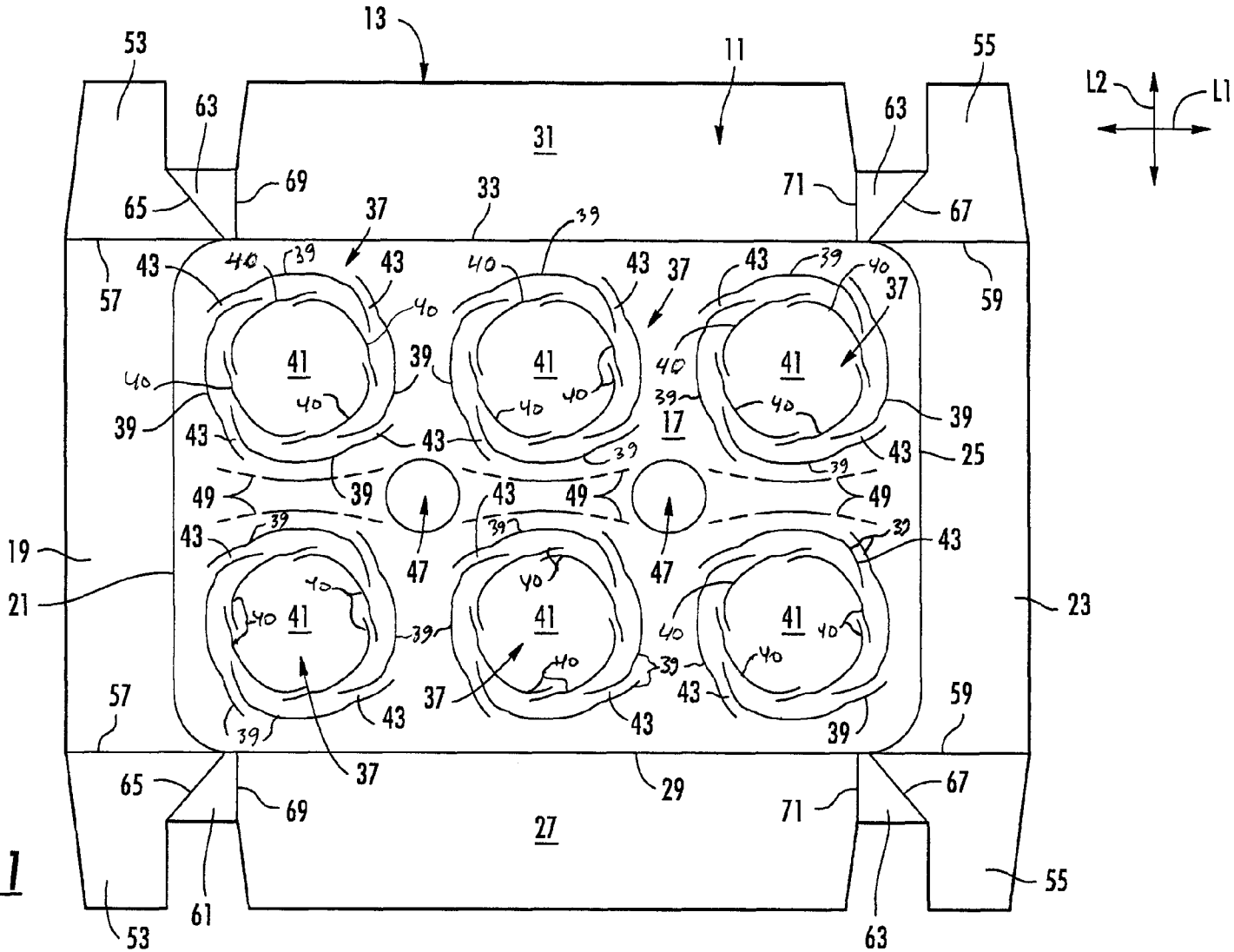
FIGS. 1-4 illustrate a blank, package, and/or container of a first embodiment of the disclosure.
Figure 2:
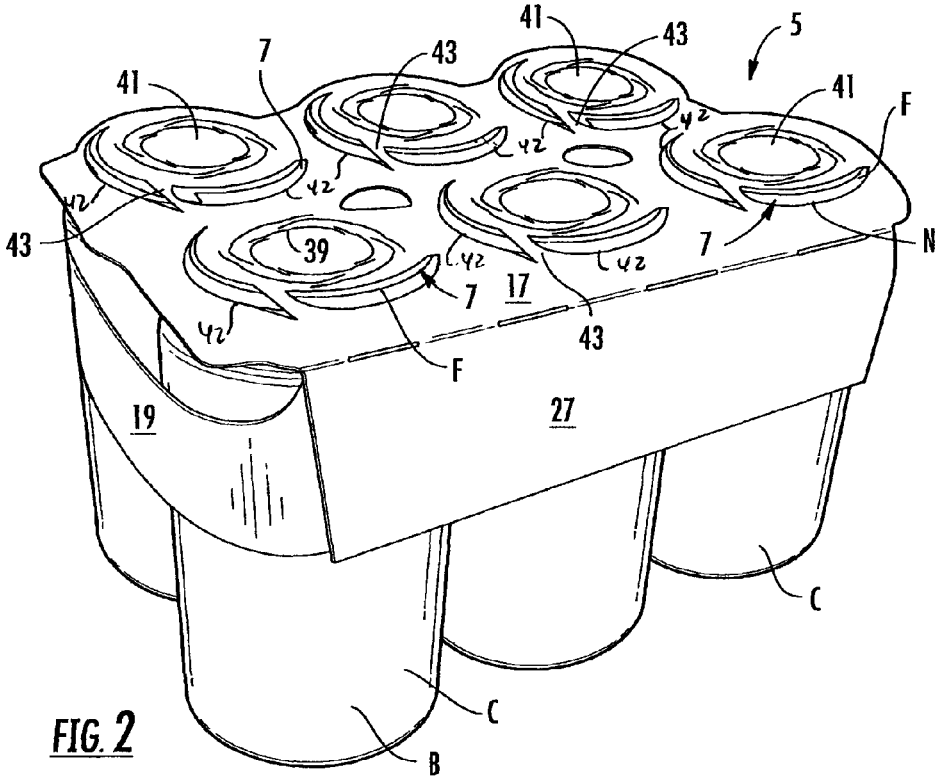

FIG. 1 is a plan view of an exterior side 11 of a blank 13 used to form the package or carrier 5. The blank 13 has a longitudinal axis L1 and a lateral axis L2. The blank 13 comprises a top panel 17 foldably connected to a first end panel 19 at a first lateral tear line 21. The top panel 17 is foldably connected to a second end panel 23 at a second lateral tear line 25. A first side panel 27 is foldably connected to the top panel 17 at a first longitudinal fold line 29. A second side panel 31 is foldably connected to the top panel 17 at a second longitudinal fold line 33.

In the embodiment of FIG. 1, the blank 13 includes six receptacles 37 formed by a series of curved cut lines 39. The receptacles 37 each include a generally circular interior panel 41 that is connected to the top panel 17 by four strips 43 located between the two outermost cut lines 39. The interior panel 41 includes curved fold lines 40 that are spaced inward from the cut lines 39 and help shape the interior panel so the interior panel conforms to the shape of the container C. When the interior panel 41 is raised relative to the top panel 17 the openings 7 in the top panel are formed by the separation of the interior panel 41 from the top panel at the cut lines 39. In the embodiment of FIG. 1, the top panel 17 includes finger holes 47 for grasping and carrying the package 5. Also, the top panel 17 includes curved fold lines 49 between respective pairs of receptacles 37.

The cut lines 39 cooperate to form retention edges 42 (broadly "retention feature") of the opening 7 in the top panel 17 that engages a flange F of the container C. In the illustrated embodiment, each receptacle 37 includes four generally arcuate retention edges that each engage a portion of the flange F of the container C to retain the container in the carton. The retention edges 42 are separated by a respective strip 43 between respective ends of the cuts 39 that attaches the interior panel 41 to the top panel 17.

In the illustrated embodiment, the blank 13 includes end flaps 53, 55 foldably connected to a respective end panel 19, 23 at a longitudinal fold line 57, 59. A gusset panel 61, 63 is respectively connected to the end flaps 53, 55 at a respective oblique fold line 65, 67. Each gusset panel 61, 63 is respectively foldably connected to a side panel 27, 31 at a respective lateral fold line 69, 71.

To form the package 50 in accordance with one acceptable method, the containers C are inserted into a respective receptacle 37 so that the top surface of the flanges F of the containers contact the interior panels 41 of the receptacles to raise the interior panels and form the openings 7 in the top panel 17. The flanges F of the containers C are positioned as shown in FIGS. 3 and 4 so that portions (e.g., edges 42) of a respective receptacle 37 adjacent the opening engages the underside of the flange to retains the container in the package 5. The end panels 19, 23 are folded downward relative to the top panel 17 and separated along tear line 21, 25 so that a top edge of the end panels is separated from the top panel. The end flaps 53, 55 are inwardly folded at fold lines 57, 59 and the side panels are downwardly folded at fold lines 29, 33 to form the package 5.

Glue or other adhesive can be applied to one or more of the panels and/or flaps of the blank 13 to secure the package 5 in the folded condition. Also, the package 5 can include handle or reinforcement features as illustrated in U.S. application Ser. No. 12/253,485 filed Oct. 17, 2008, the entire contents of which are incorporated by reference herein for all purposes. Further, the package 5 could include dispensing features for facilitating removal of the containers C from the package. The blank 13 could be otherwise shaped and/or arranged and the package 5 could have features that are otherwise shaped and/or arranged without departing from the disclosure.

Figure 5:
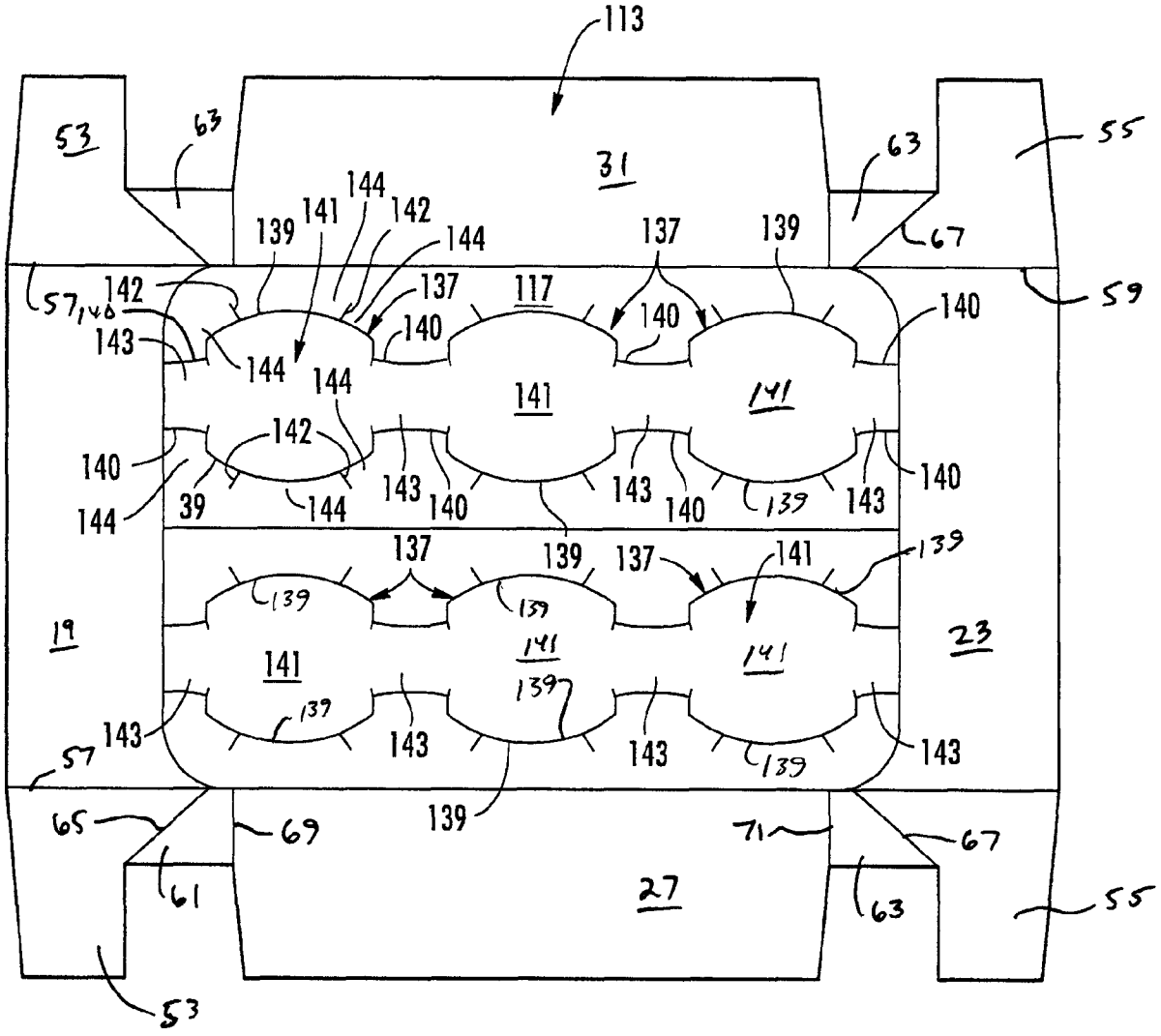
FIGS. 5-7 illustrate a blank and/or a package holding a plurality of containers of a second embodiment of the disclosure.
Figure 6:
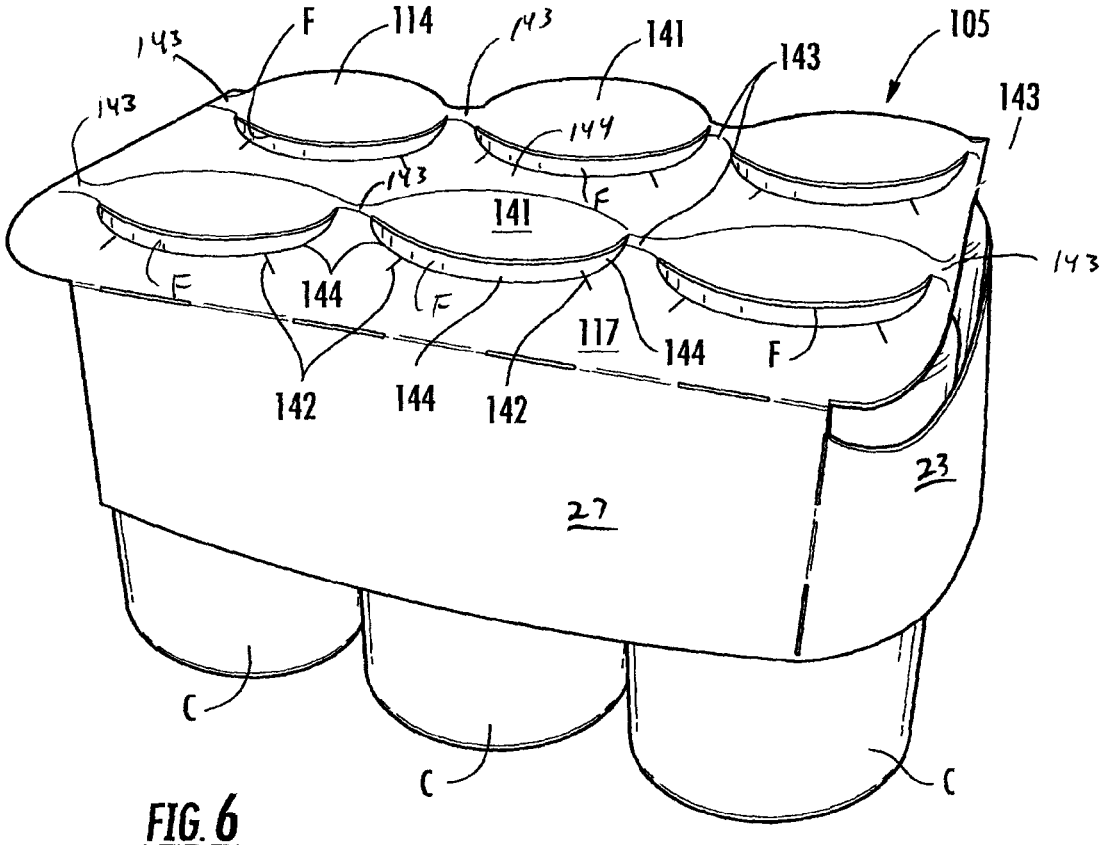
Figure 7:
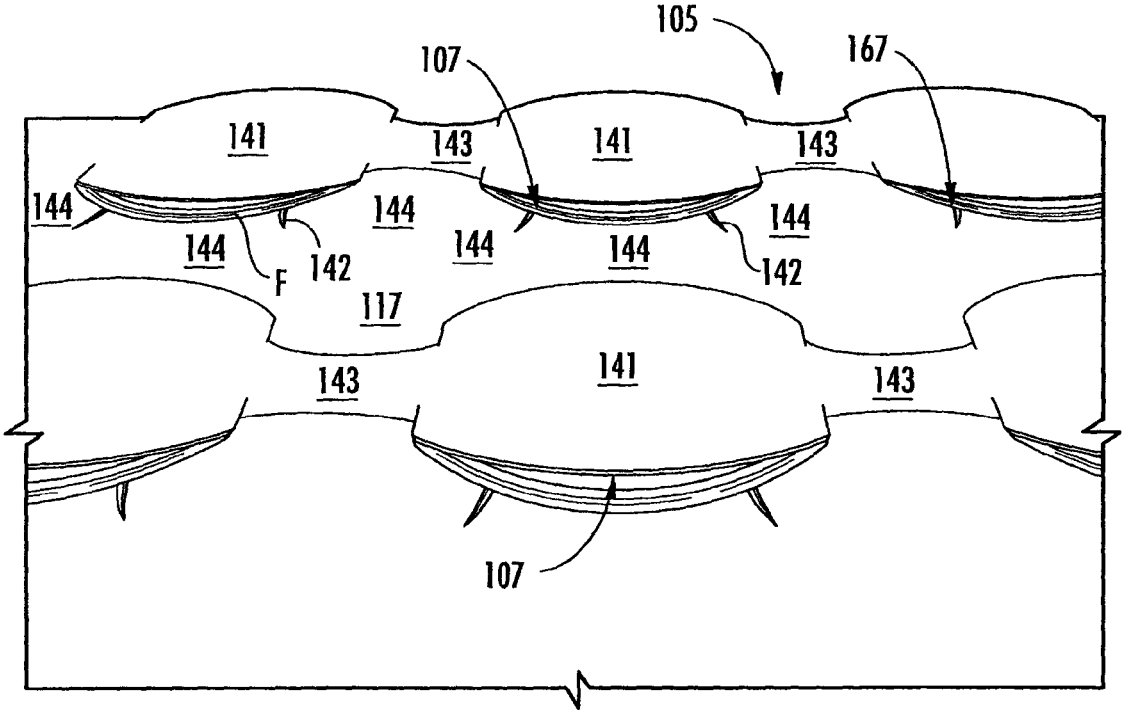

FIGS. 5-7 respectively show a blank 113 and a package 105 of a second embodiment of the disclosure having similar features as the blank 13 and package 5 of the first embodiment. Accordingly, similar or identical features of the embodiments are provided with like reference numbers.

In the embodiment of FIGS. 5-7, the central panels 141 of each of the receptacles 137 remain attached to the top panel 117 by respective tabs 143 at longitudinal ends of the central panels 141. Each of the tabs 143 is defined by the spaced apart ends of cuts 139 forming the central panel 141 of the receptacles 137 and curved fold lines 140 attaching the tabs to the top panel 117. The receptacles 137 include oblique cuts 142 extending from the cuts 139 forming the central panel 141. The oblique cuts 142 form foldable flaps 144 in the top panel 117 that are adjacent the openings 107. The edges of the foldable flaps 144 are defined by the cuts 139 and are for engaging the underside of the flanges F of the containers C. The blank 113 could be otherwise shaped and/or arranged and the package 105 could have features that are otherwise shaped and/or arranged without departing from the disclosure.

Figure 8:
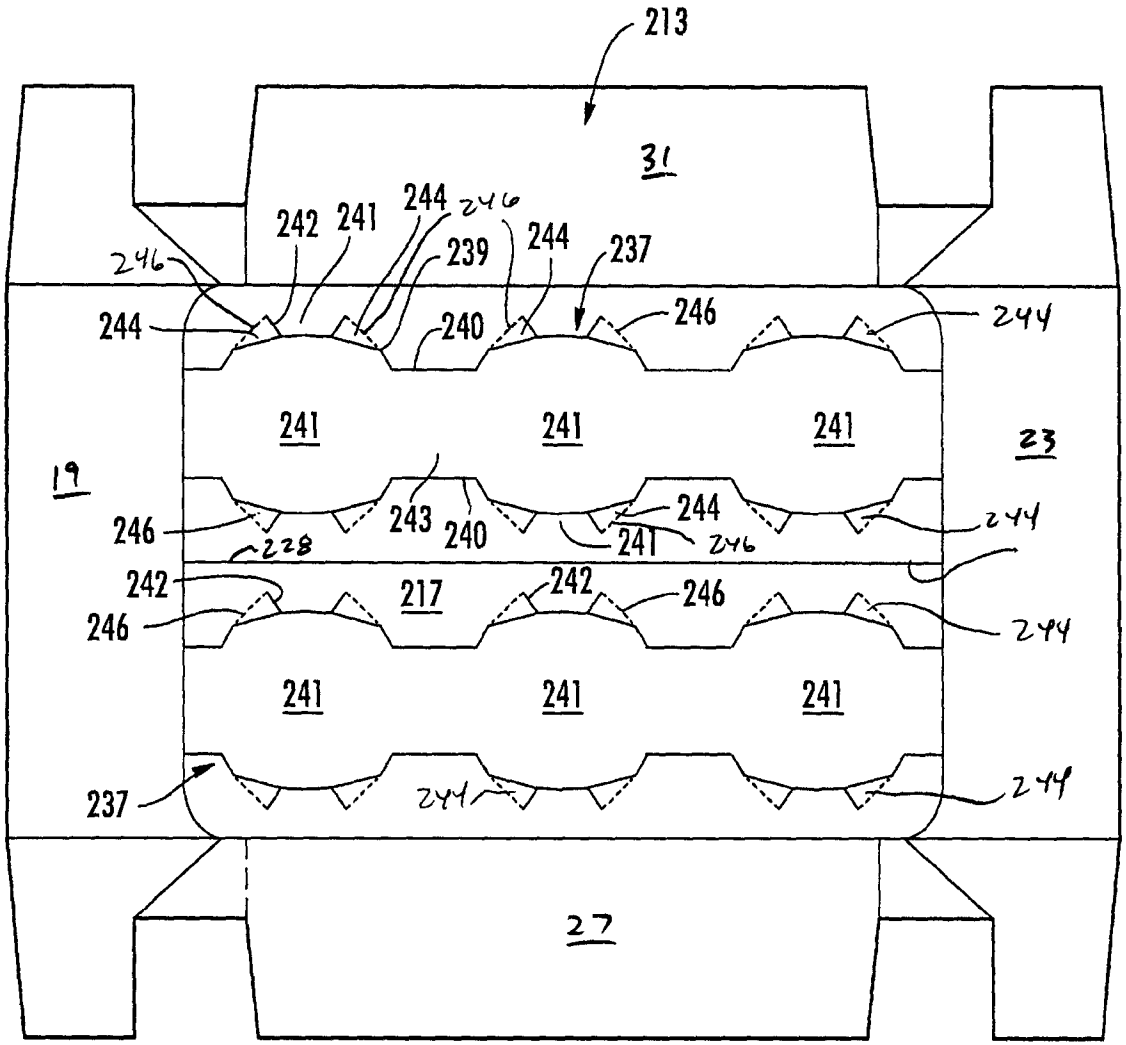
FIGS. 8-10 illustrate a blank and/or a package holding a plurality of containers of a third embodiment of the disclosure.
Figure 9:
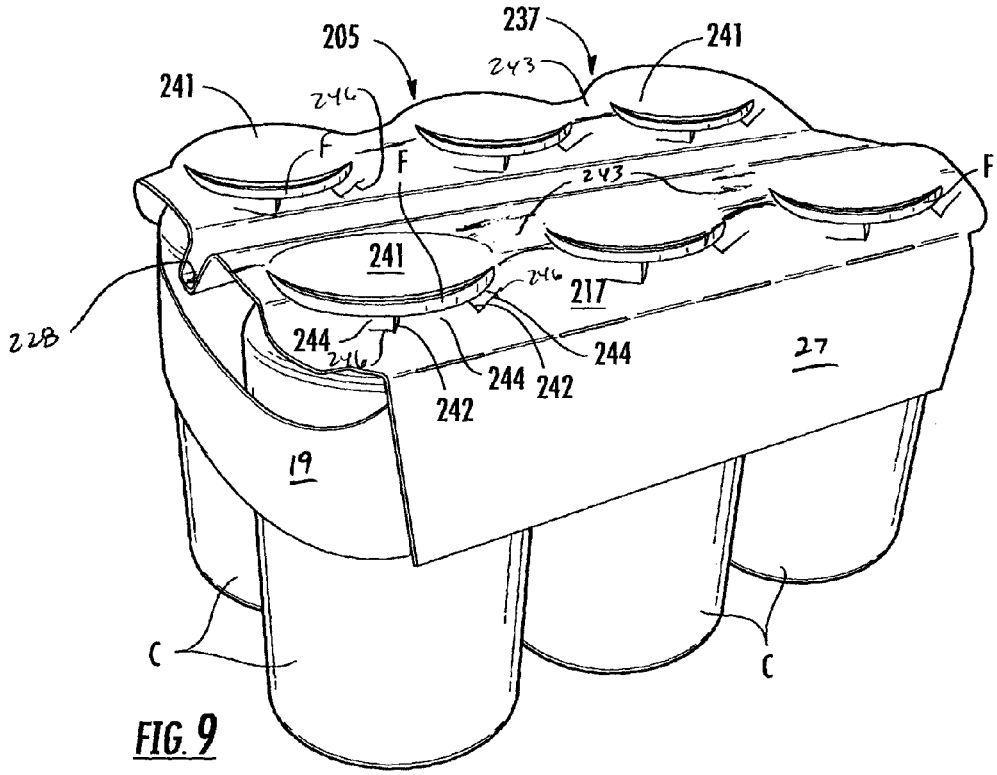
Figure 10:
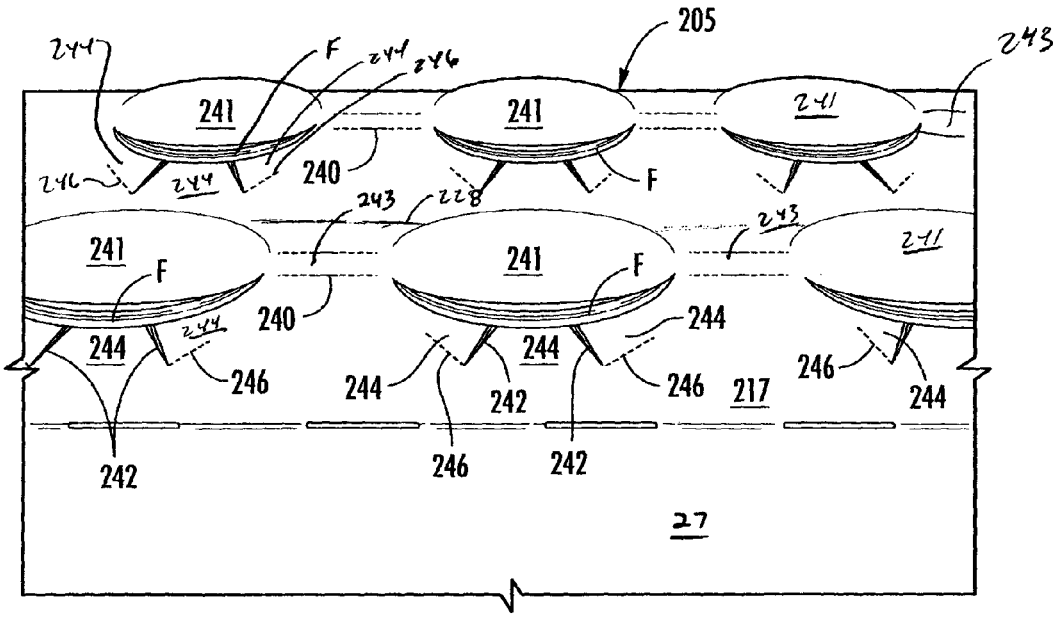

FIGS. 8-10 show a blank 213 for forming a package 205 of a third embodiment of the disclosure having similar features as the blank and packages of the previous embodiments. Accordingly, similar or identical features of the embodiments are provided with like reference numbers.

The blank 213 includes a top panel 217 having receptacles 237 similar to the receptacles 137 of the previous embodiment. In the embodiment of FIGS. 8-10, the central panels 241 are similarly shaped as the central panels 141. The foldable flaps 244 are formed by the oblique cuts 242. In the embodiment of FIGS. 8-10, the foldable flaps 244 are at least partially defined by oblique fold lines 246 that extend between the oblique cuts 242 and the cuts 139 defining the central panel 241. In the embodiment of FIGS. 8-10, the tabs 243 are formed by generally straight fold lines 240. In one embodiment, the top panel 217 includes a longitudinal fold line 228 that extends across the length of the top panel. The fold line 228 facilitates forming the package 205 and allows the top panel 217 to conform to the shape of the containers C. The blank 213 could be otherwise shaped and/or arranged and the package 205 could have features that are otherwise shaped and/or arranged without departing from the disclosure.

Figure 11:
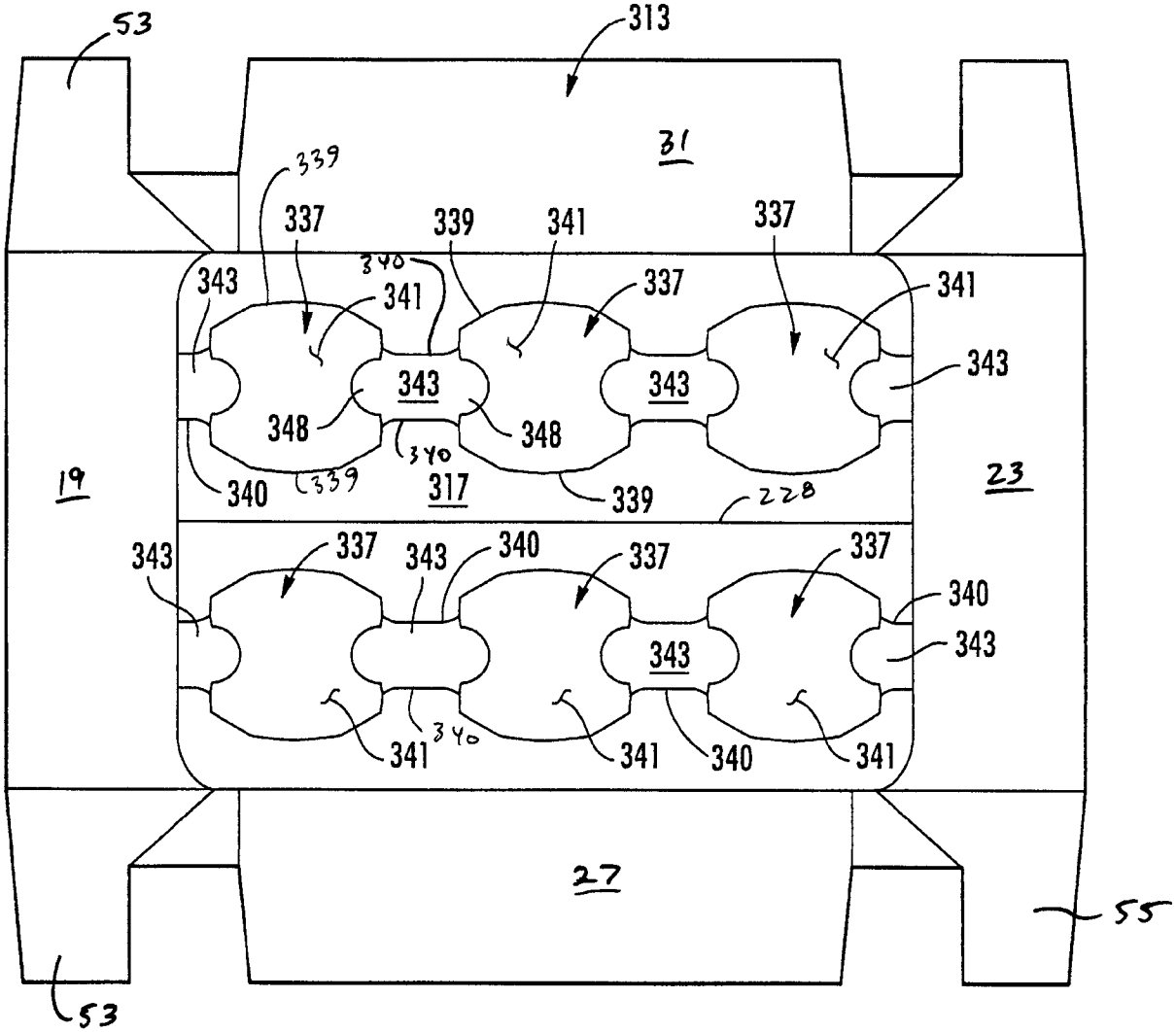
FIGS. 11-13 illustrate a blank and/or a package holding a plurality of containers of a fourth embodiment of the disclosure.
Figure 12:
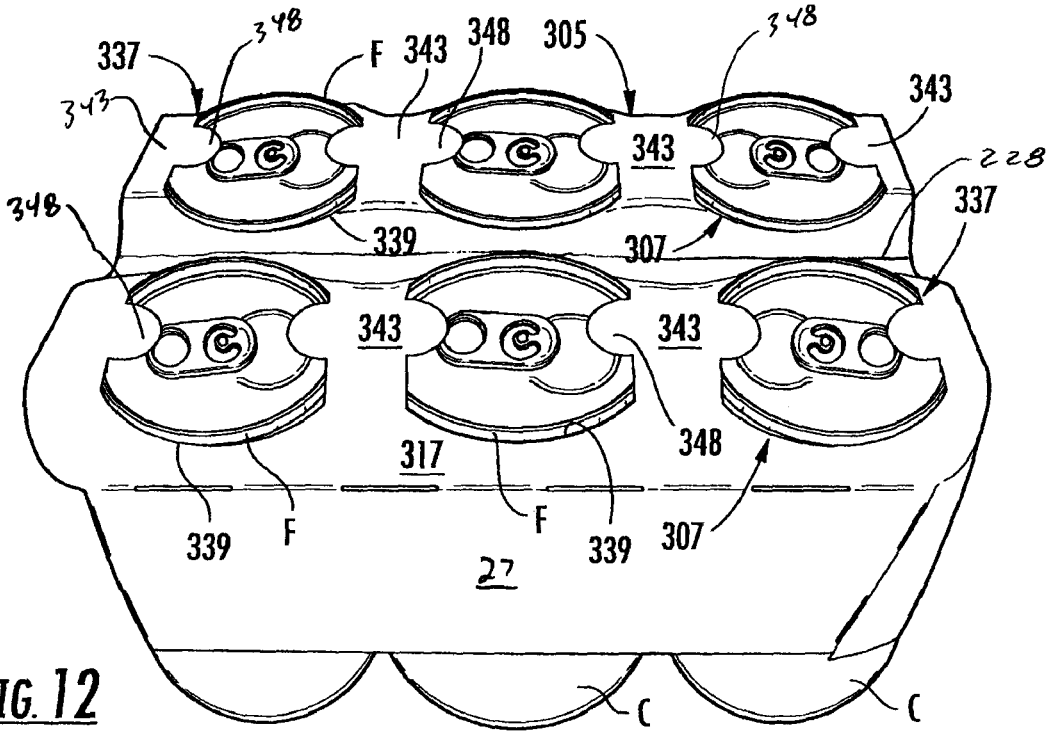
Figure 13:
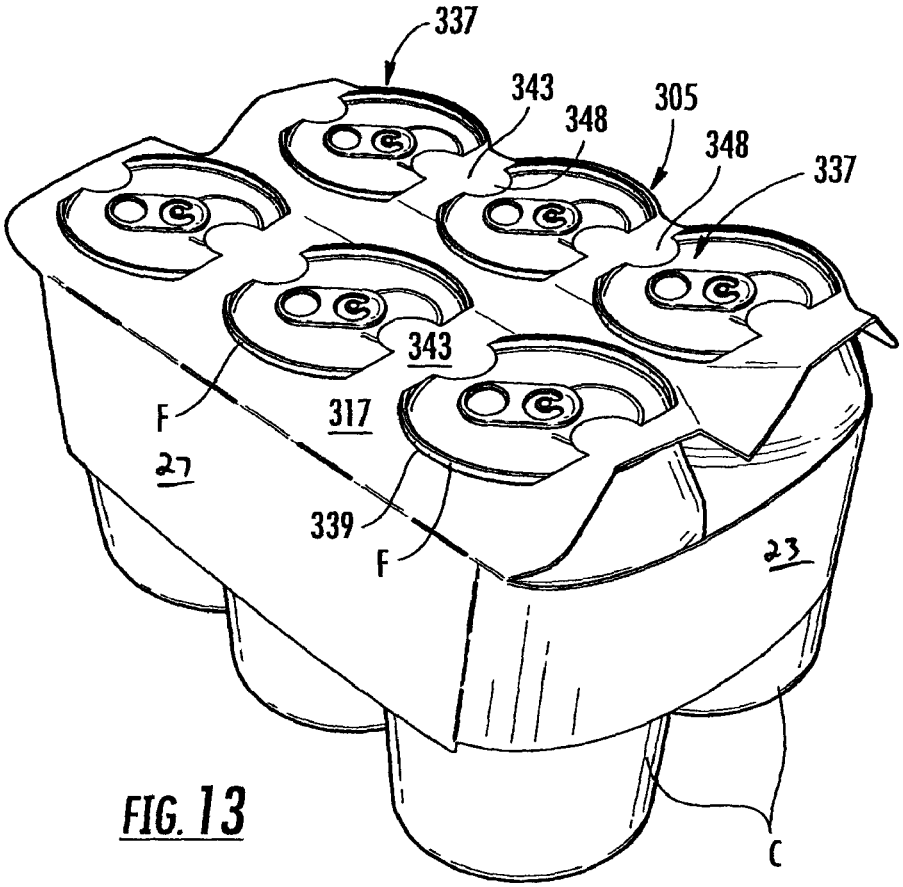

FIGS. 11-13 show a blank 313 for forming a package 305 of a fourth embodiment of the disclosure having similar features as the blank and packages of the previous embodiments. Accordingly, similar or identical features of the embodiments are provided with like reference numbers.

The blank 313 includes receptacles 337 that have openings 341 in the top panel 317. The receptacles 337 include tabs 343 adjacent respective longitudinal sides of the openings 341. The tabs 343 are defined by curved fold lines 340 in the top panel. The openings 341 have curved edges 339, formed by correspondingly shaped curved cuts lines in the blank 313, that extend generally in the longitudinal direction L1. As shown in FIGS. 12 and 13, the curved edges 339 engage an underside of the flange F of a respective container to retain the containers in the package 305. The tabs 343 include protruding portions 348 that are generally semi-circular shaped and located between the curved edges 339. In the illustrated embodiment, the protruding portions 348 of the tabs 343 are in contact with a top surface of the flange F of the containers C and are spaced apart from the top panel 317 of the package 305. The blank 313 could be otherwise shaped and/or arranged and the package 305 could have features that are otherwise shaped and/or arranged without departing from the disclosure.

Figure 14:
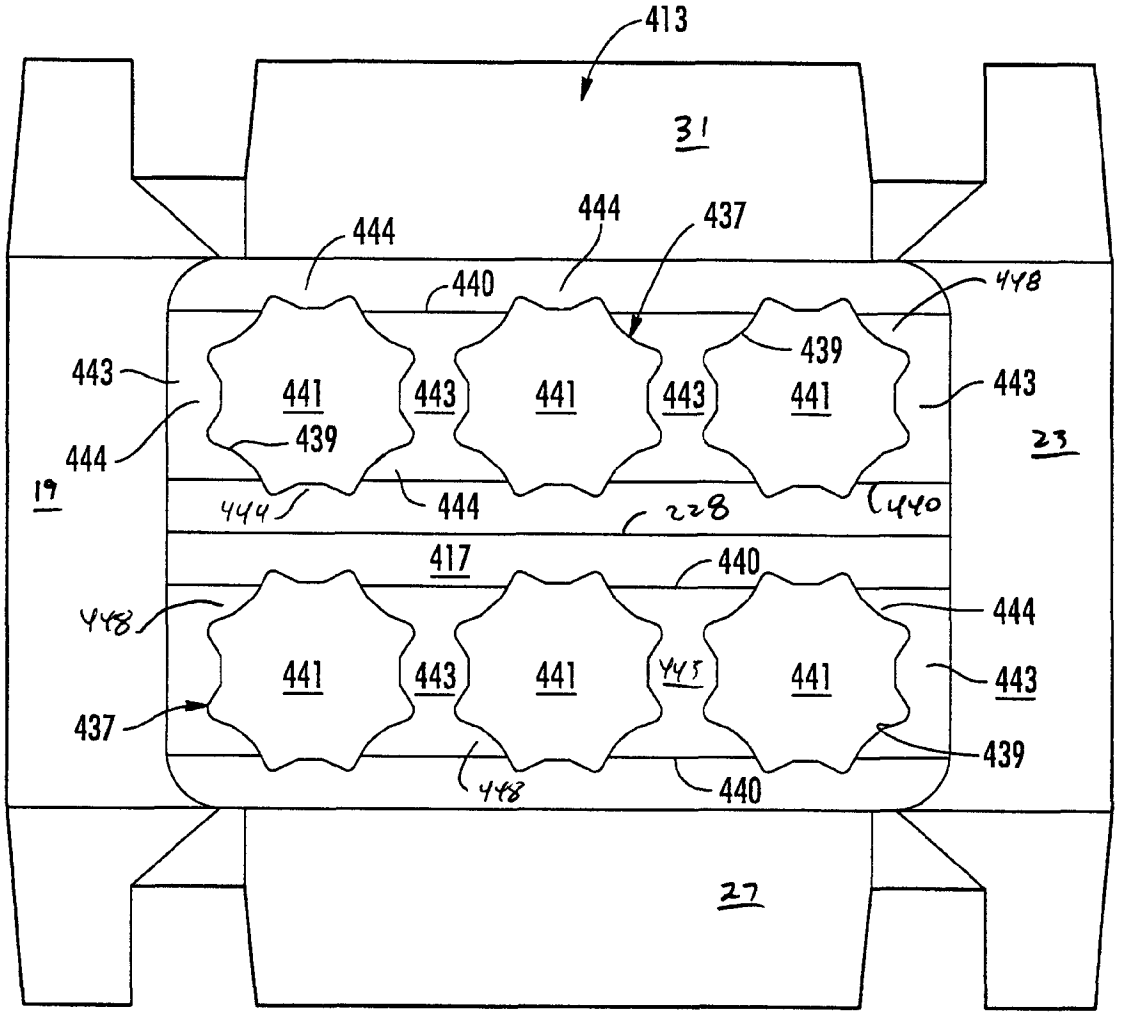
FIGS. 14-16 illustrate a blank and/or a package holding a plurality of containers of a fifth embodiment of the disclosure 5.
Figure 15:
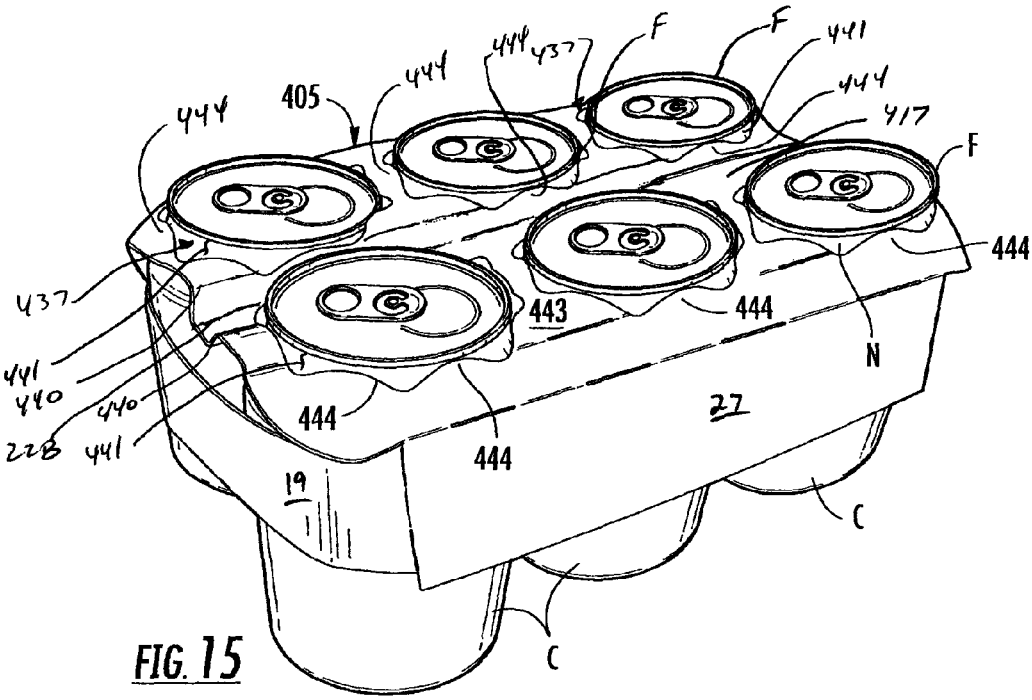
Figure 16:
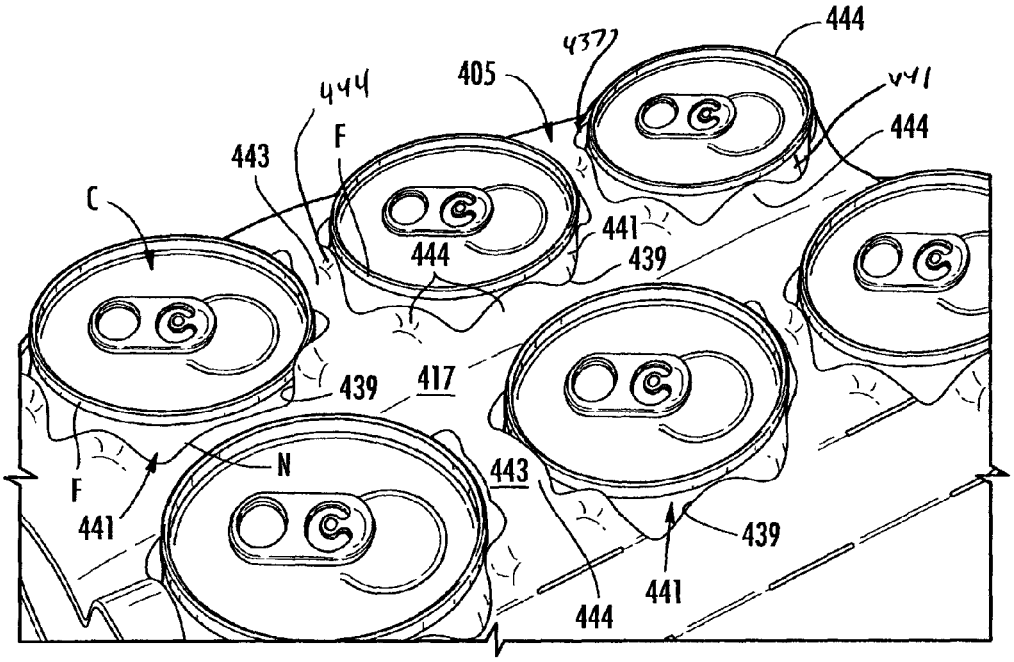

FIGS. 14-16 show a blank 413 for forming a package 405 of a fifth embodiment of the disclosure having similar features as the blank and packages of the previous embodiments. Accordingly, similar or identical features of the embodiments are provided with like reference numbers.

The blank 413 includes receptacles 437 that have openings 441 in the top panel 417. The openings 441 are generally star-shaped and are formed by respective edges 439. The edges 439 of the openings 441 have curved portions that form respective foldable flaps 444 that are adjacent the openings 441. The foldable flaps 444 protrude into a respective opening 441 and engage an underside of a respective flange F of the containers C. The tabs 443 between the openings 441 are defined by longitudinal fold line 440. In the illustrated embodiment, each receptacle 437 includes eight foldable flaps 444. The blank 413 could be otherwise shaped and/or arranged and the package 405 could have features that are otherwise shaped and/or arranged without departing from the disclosure.

Figure 17:
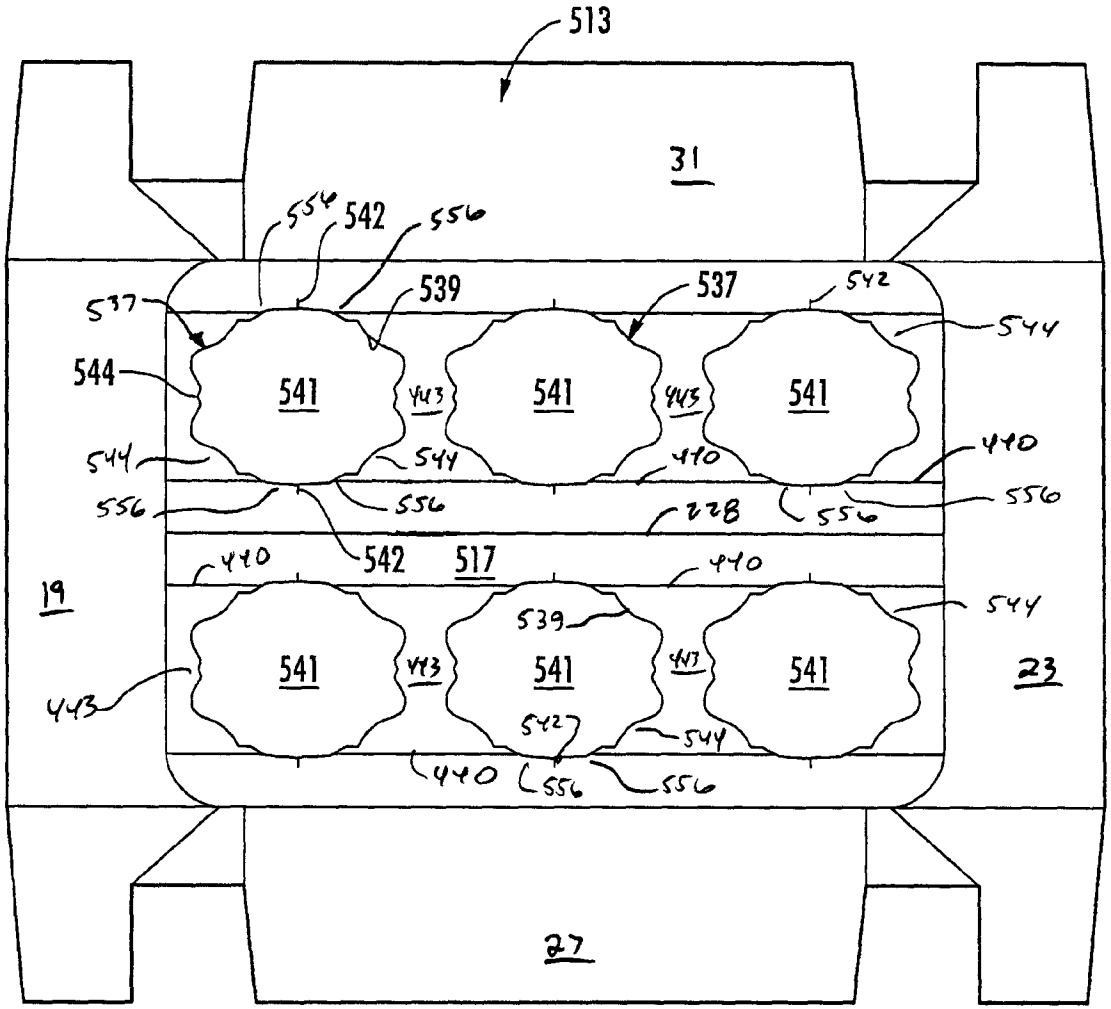
FIGS. 17-19 illustrate a blank and/or a package holding a plurality of containers of a sixth embodiment of the disclosure
Figure 18:
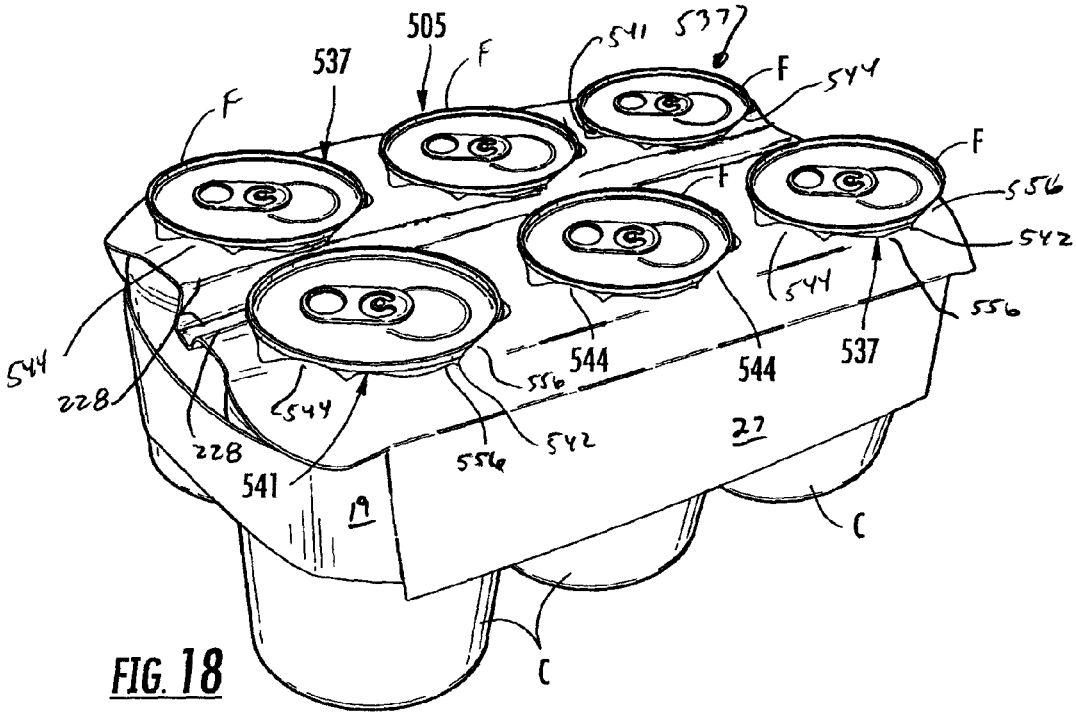
Figure 19:
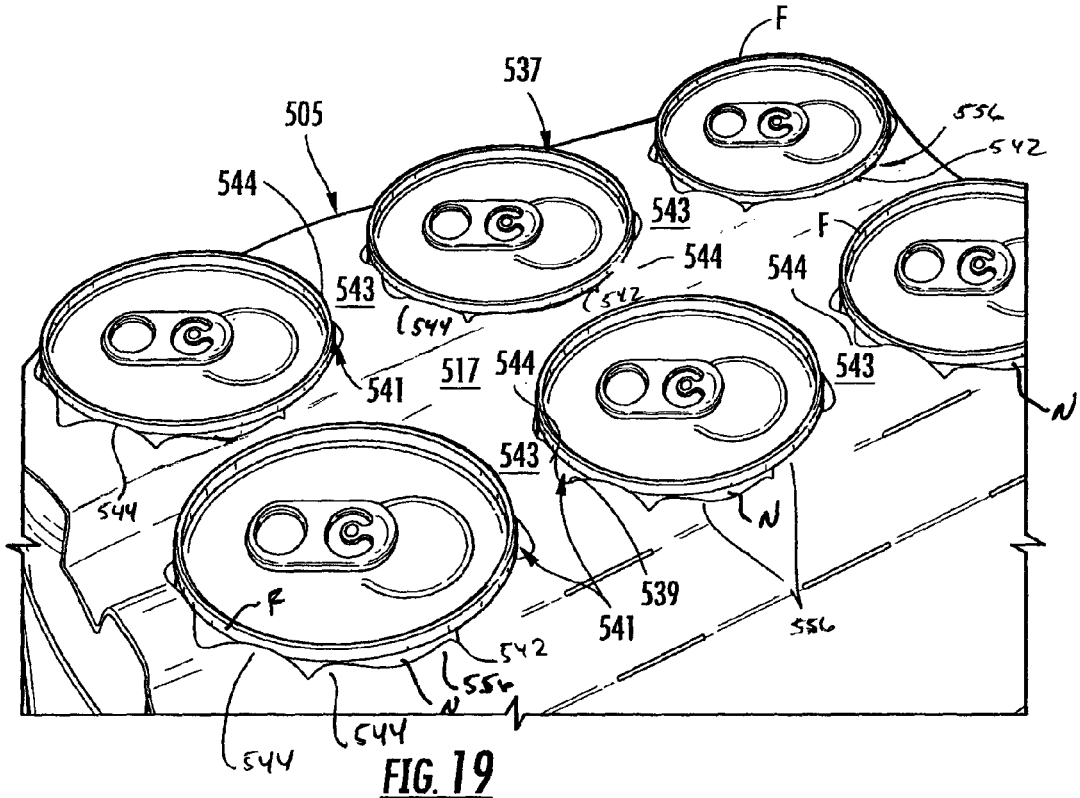

FIGS. 17-19 show a blank 513 for forming a package 505 of a sixth embodiment of the disclosure having similar features as the blank and packages of the previous embodiments. Accordingly, similar or identical features of the embodiments are provided with like reference numbers.

The blank 513 includes receptacles 537 similar to the receptacles 437 of the previous embodiment. The openings 541 have an edge 539 that is similar in shape as the edge 439 of the previous embodiment. Foldable flaps 544 are formed by portions of the edge 539 adjacent the opening 541. The foldable flaps 544 protrude into a respective opening 541 and engage an underside of a respective flange F of the containers C. In the embodiment of FIGS. 17-19, the blank 513 comprises retention flaps 556 adjacent the opening 541 that are formed by lateral cuts 542. The retention flaps 556 do not protrude into the opening 541 so that the retention flaps engage the neck N of the containers at a location spaced below the underside of the flange F. The retention flaps 556 provide additional attachment force that secures the package 505 to the containers C. In the embodiment of FIGS. 17-19, the package has six foldably flaps 544 adjacent each opening 541 that engage the underside of the flange F and four retention flaps 556 adjacent each opening that engage the neck N of a respective container C. The blank 513 could be otherwise shaped and/or arranged and the package 505 could have features that are otherwise shaped and/or arranged without departing from the disclosure.

Figure 20:
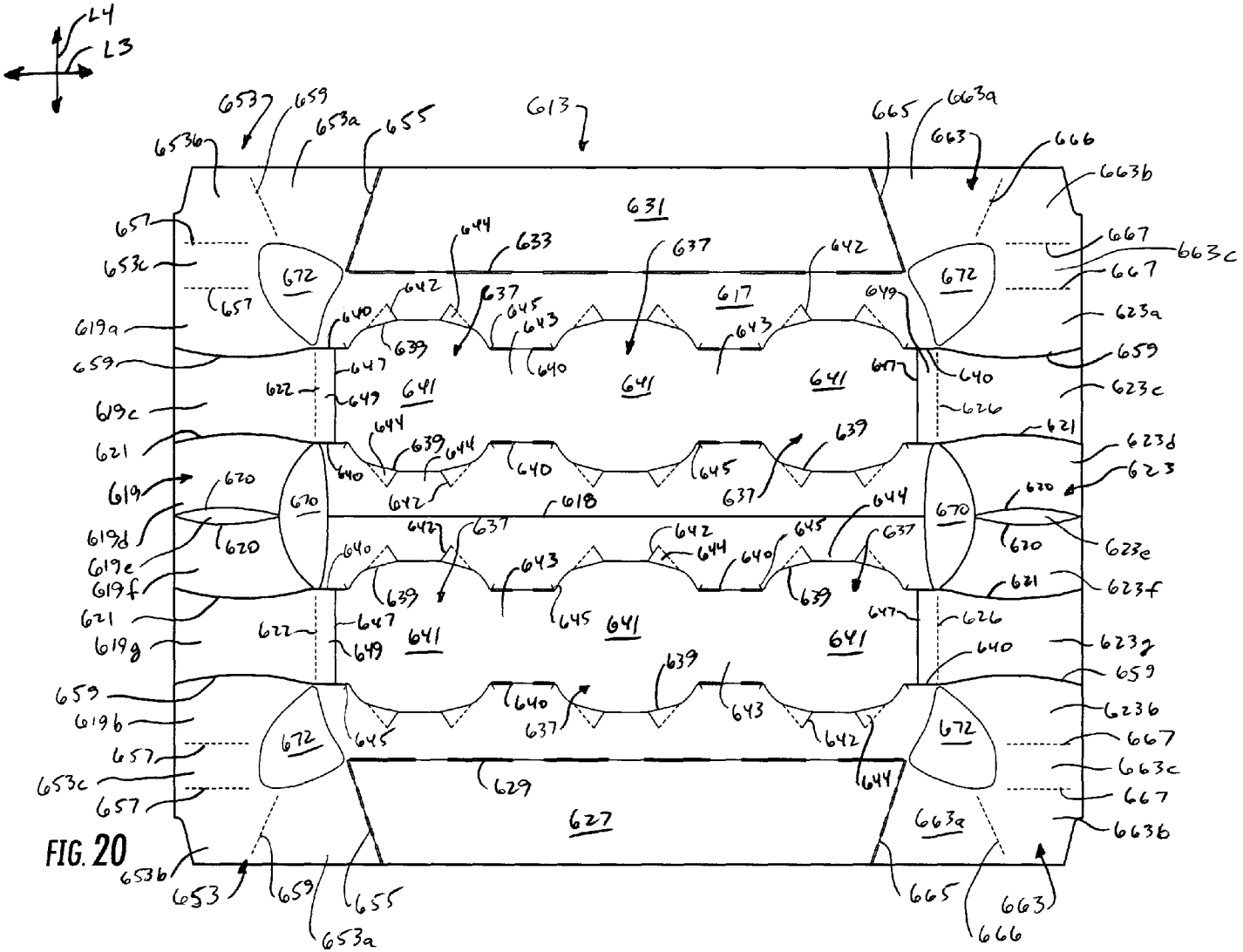
FIGS. 20-22 illustrate a blank and/or a package holding a plurality of containers of a seventh embodiment of the disclosure.
Figure 21:
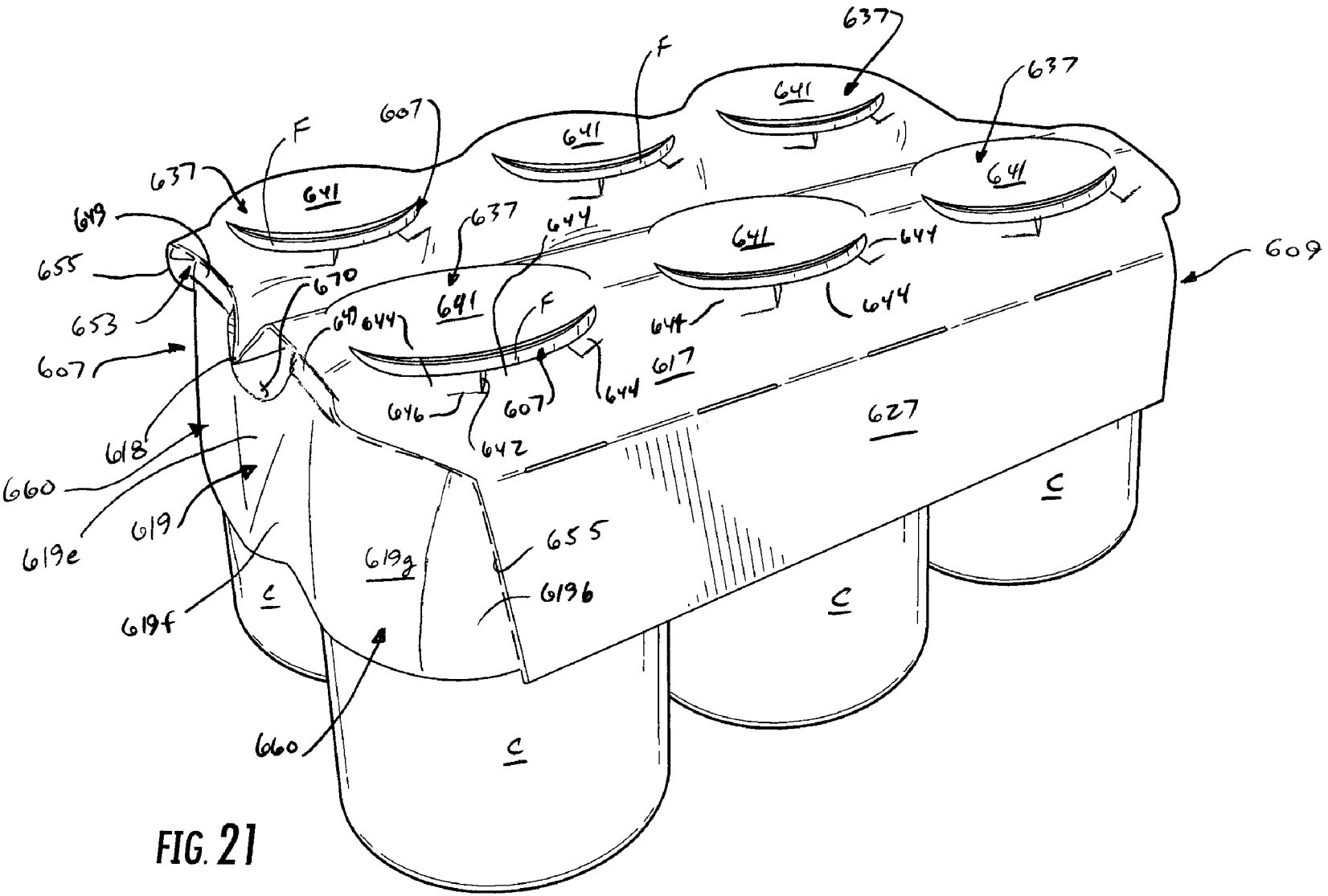
Figure 22:
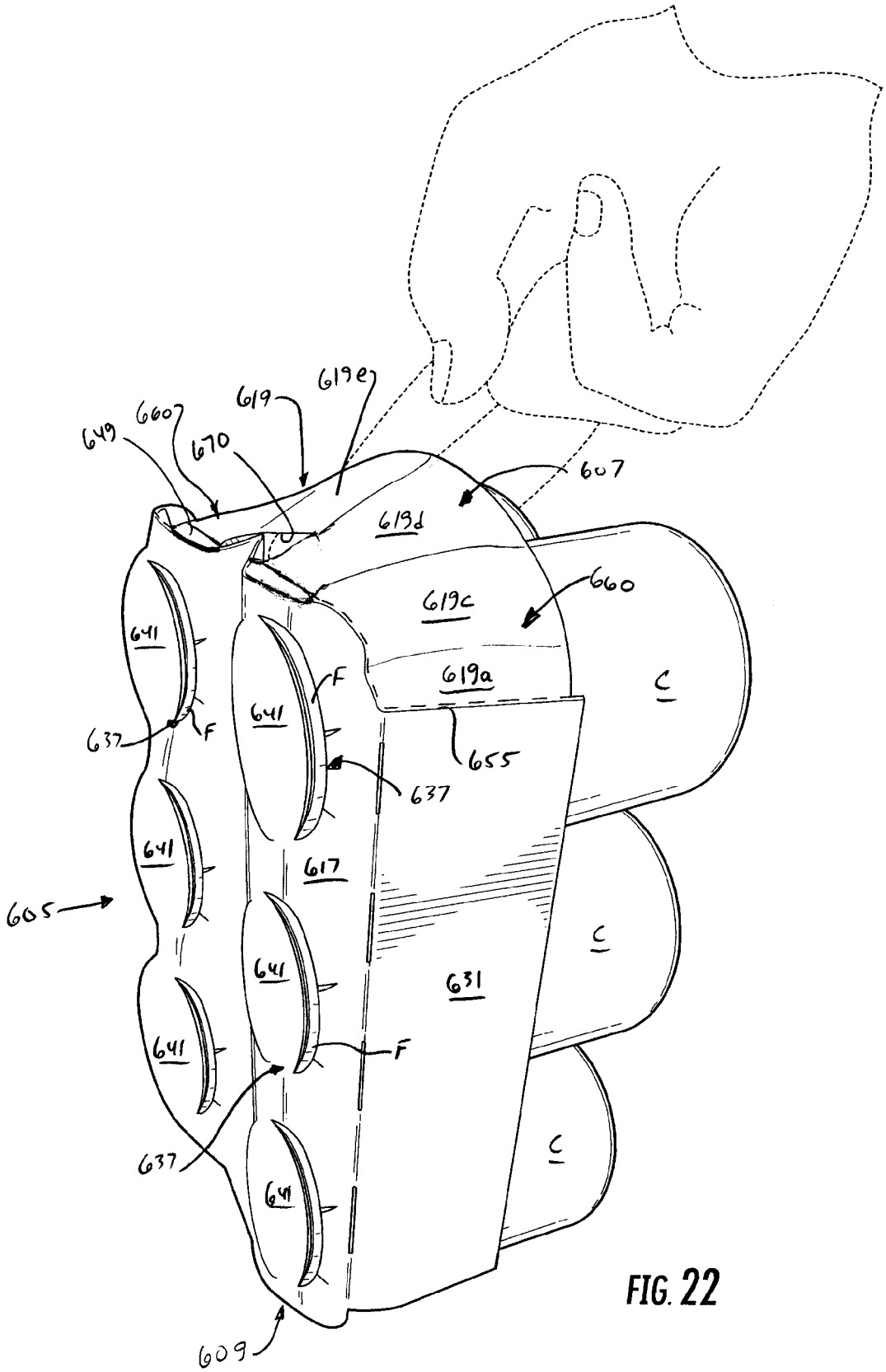

FIGS. 20-22 show a blank 613 for forming a package 605 of a seventh embodiment of the disclosure having similar features as the blank and packages of the previous embodiments. The package 605 has handles 607, 609 at respective ends that are formed from handle features of the blank 313. Accordingly, similar or identical features of the embodiments are provided with like reference numbers.

FIG. 20 is a plan view of an exterior side of a blank 613 used to form the package or carrier 605 (FIGS. 21-22). The blank 613 has a longitudinal axis L3 and a lateral axis L4. The blank 613 comprises a top panel 617 foldably connected to a first end panel 619 and a second end panel 623. A first side panel 627 is foldably connected to the top panel 617 at a first longitudinal fold line 629. A second side panel 631 is foldably connected to the top panel 617 at a second longitudinal fold line 633.

In the embodiment of FIG. 20, the blank 613 includes six receptacles 637 arranged in two longitudinal rows and formed by a series of curved cut lines 639. The top panel 617 is divided by a longitudinal fold line 618 extending between the two rows of receptacles 637. The receptacles 637 each include a generally circular central panel 641. The central panels 641 are connected to the top panel 617 by respective tabs 643, 649. The tabs 643 are defined by respective inner longitudinal fold lines 640 extending between respective pairs of receptacles 637. The tabs 649 that are adjacent the end panel 619 and respective end receptacles 637 are defined by respective lateral fold lines 622, 647 and respective inner longitudinal fold lines 640 extending between the lateral fold lines. The tabs 649 that are adjacent the end panel 623 and respective end receptacles 637 are defined by respective lateral fold lines 626, 647 and respective inner longitudinal fold lines 640 extending between the lateral fold lines.

In the embodiment of FIGS. 20-22, the receptacles 637 are similar to the receptacles 237 of the third embodiment. The receptacles have oblique cuts 642 extending from the curved cut lines 639 forming the central panels 641. Oblique fold lines 646 extend between the oblique cuts 642 and the cuts 639 defining the central panel 641. The oblique cuts 642 and oblique fold lines 646 form foldable flaps 644 in the top panel 617 that are adjacent the curved cut lines 639. When an interior panel 641 is raised relative to the top panel 617 by the insertion of a container C in the respective receptacle 637, a respective opening 607 is formed in the top panel 617. As shown in FIG. 21, the foldable flaps 644 are configured to engage the underside of the flanges F of the containers C when the containers C are inserted in the receptacles 637. The top panel 617 may also include oblique nicks or creases 645 at junction points between curved cut lines 639 and longitudinal fold lines 640 to facilitate folding of the flaps 644.

In one embodiment, the end panel 619 includes a first corner portion 619*a*, a second corner portion 619*b*, and intermediate portions 619*c-g* extending between the first and second corner portions. A pair of curved, laterally innermost fold lines 620 which are joined at their endpoints, form the intermediate portion 619*e* which is generally laterally aligned with the fold line 618 on the lateral centerline of the blank 613. A pair of curved, laterally intermediate fold lines 621 are spaced laterally outwardly from a respective curved inner fold lines 620 and form a respective intermediate portion 619*d*, 619*f* at opposing lateral sides of the curved fold lines 620. A pair of curved fold lines 659 is spaced laterally outward from a respective intermediate fold line 621 and cooperates with a respective intermediate fold line 621 to form a respective intermediate portion 619*c*, 619*g*. In the illustrated embodiment, the intermediate portions 619*d*, 619*e*, 619*f* are separated from the top panel 617 by an opening 670. The opening 670 is illustrated as being generally oval and positioned to abut the top panel 617, however, the opening could be otherwise shaped, positioned, arranged, configured, or the opening could be omitted, without departing from the disclosure.

The end panel 623 is similar to the end panel 619 having corner portions 623*a*, 623*b* and intermediate portions 623*c-g* and having fold lines 620, 621, 659 forming the corner portions and intermediate portions. Further, the end panel 623 has an opening 670. The end panel 623 could be otherwise shaped, arranged, and/or configured without departing from the disclosure.

In the illustrated embodiment, the blank 613 includes gussets 653, 663 foldably connected to respective side panels 627, 631 at oblique fold lines 655, 665 and respective end panels 619, 623 at oblique fold lines 659, 669. Each gusset 653 includes an oblique fold line 656 and a pair of longitudinal fold lines 657. A first gusset panel 653*a* is defined between the oblique fold line 655 and the oblique fold line 656. A second gusset panel 653*b* is defined between the oblique fold line 656 and a first one of the longitudinal fold lines 657. A third gusset panel 653*c* is defined between the longitudinal fold lines 657. Each gusset 653 is separated from the top panel 617 by an opening 672 that borders the gusset panels 653*a*, 653*b*, 653*c* and corner portion 619*a*, 619*b* of the end panel 619. The openings 672 could be otherwise shaped, arranged, and/or configured, or the openings could be omitted, without departing from the disclosure.

The gussets 663 are similar to the gussets 653. Specifically, each gusset 663 includes an oblique fold line 666, a pair of longitudinal fold lines 667, and gusset panels 663*a*, 663*b*, 663*c*. Each gusset 663 is separated from the top panel 617 by an opening 672 that borders the gusset panels 663*a*, 663*b*, 663*c* and corner portion 623*a*, 623*b* of the end panel 623. One or more of the gussets 653, 663 could be otherwise shaped, arranged, configured, or omitted without departing from the disclosure.

To form the package 605 shown in FIGS. 21 and 22, in accordance with one acceptable exemplary method, the containers C are each inserted into a respective receptacle 637. As a consequence, the top surfaces of the flanges F of the containers C contact the interior panels 641 of the receptacles 637 and raise the central panels 641, thereby forming the openings 607 in the top panel 617. The flanges F of the containers C are positioned as shown in FIGS. 21 and 22 so that the flap 644 of a respective receptacle 637 adjacent an opening 607 engages the underside of the flange F to retain the container in the package 605. Central regions of the top panel 617 between the rows of receptacles 637 are folded downwardly to form a V-shaped trench, and outer regions of the top panel 617 adjacent the side panels 627, 631 are folded to slope downwardly from the receptacles 637. The end panels 619, 623 are folded downwardly relative to the top panel 617 along respective fold lines 622, 626. The side panels 627, 631 are downwardly folded at the respective fold lines 629, 633. The gusset panels 653*a* are folded at the oblique fold lines 656 such that the gusset panels 653*a* overlie the gusset panels 653*b*, 653*c*, and the oblique fold lines 655 connecting the gussets 653 to respective side panels 627, 631 are positioned adjacent the corner portions 619*a*, 619*b* of the end panel 619. Similarly, the gusset panels 663*a* are folded at the oblique fold lines 666 such that the gusset panels 663*a* overlie the gusset panels 663*b*, 663*c*, and the oblique fold lines 665 connecting the gussets 663 to respective side panels 627, 631 are positioned adjacent the corner portions 623*a*, 623*b* of the end panel 623. Thus, the package 605 is formed.

In the package 605, the end panels 619, 623 follow the contour of the containers C. Specifically, the end panel portions 619*c*, 619*g* and corner portions 619*a*, 619*b* form substantially convex end portions 660 that generally conform to the shape of the container C. The end panel portions 619*d*, 619*e*, and 619*f* can be folded inwardly to form a substantially concave intermediate portion 662 that is between the convex end surfaces 660. The concave intermediate portion 662 is positioned between the two end containers C and is shaped to conform to the shape of the containers. Similarly, the end panel portions 623*c*, 623*g* and corner portions 623*a*, 623*b* form substantially convex end portions 660, and the end panel portions 623*b*, 623*e*, and 623*f* can be folded inwardly to form a substantially concave intermediate end portion 662. Glue or other adhesive can be applied to one or more of the panels and/or flaps of the blank 613 to secure the package 605 in the folded condition. For example, the gusset sections 653*a* may be adhesively secured to gusset sections 653*b*, 653*c* and the gusset sections 663*a* may be adhesively secured to gusset sections 663*b*, 663*c*.

As shown in FIGS. 21 and 22, the end panels 619, 623 each comprise handle features for forming a respective handle 607, 609 that can be configured for carrying the package. Specifically as shown in FIG. 22, to activate the handle 607, the intermediate portion 662 formed by the end panel portions 619*d*, 619*e*, 619*f* of end panel 619 can be grasped and folded outwardly for carrying the package 605. Similarly, the handle 609 can be activated by grasping and folding outward the intermediate portion 620 formed by the end panel portions 623*d*, 623*e*, 623*f* of end panel 623. When the package 605 is carried by the handle 607 at end panel 619 or the handle 609 at the end panel 623, the end panel portions 619*c*, 619*g* or 623*c*, 623*g* and the corner portions 619*a*, 619*b* or 623*a*, 623*b* flex outwardly with the end panel portions 619*d*, 619*e*, 619*f* or 623*d*, 623*e*, 623*f* to facilitate carrying of the package 605.

It should be understood that the blank 613 could be otherwise shaped and/or arranged and the package 605 could have features that are otherwise shaped and/or arranged without departing from the disclosure.

FIGS. 23-26 show a blank 713 for forming a package 705 of an eighth embodiment of the disclosure having similar features as the blank and packages of the previous embodiments. Accordingly, similar or identical features of the embodiments are provided with like reference numbers.

Figure 23:
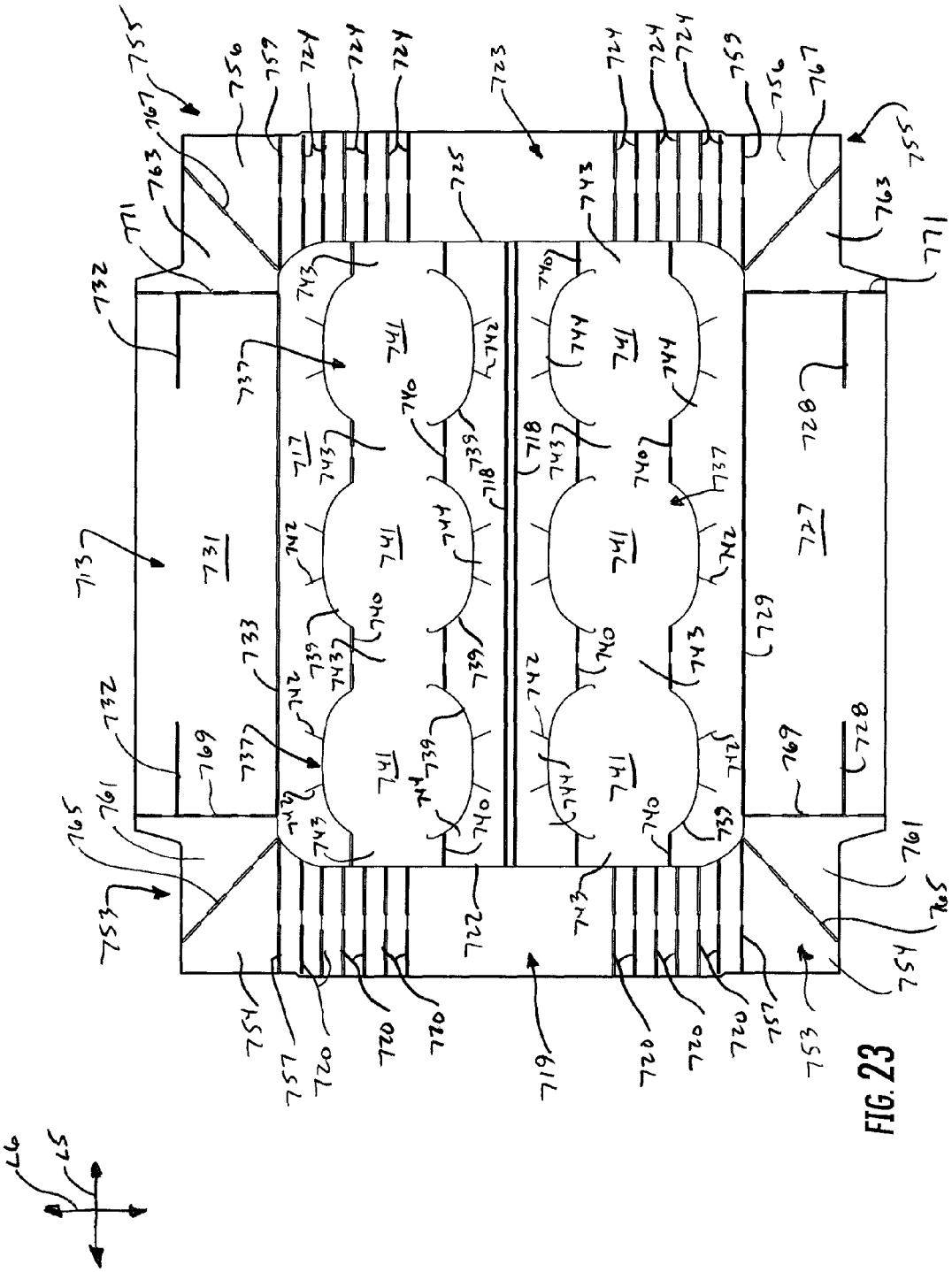
FIGS. 23-26 illustrate a blank and/or a package holding a plurality of containers of an eighth embodiment of the disclosure.

FIG. 23 is a plan view of an exterior side of a blank 713 used to form the package or carrier 705 (FIGS. 24-26) of the eighth embodiment. The blank 713 has a longitudinal axis L5 and a lateral axis L6. The blank 713 comprises a top panel 717 foldably connected to a first end panel 719 at a first lateral tear line 722. The top panel 717 is foldably connected to a second end panel 723 at a second lateral tear line 725. A first side panel 727 is foldably connected to the top panel 717 at a first longitudinal fold line 729. A second side panel 731 is foldably connected to the top panel 717 at a second longitudinal fold line 733. In alternative embodiments, the tear lines 722, 725 could be cut lines without departing from the disclosure.

In the embodiment of FIGS. 23-26, the blank 713 includes six receptacles 737 arranged in two longitudinal rows and formed by a series of curved cut lines 739. The top panel 717 is divided by a pair of longitudinal fold line 718 extending between the two rows of receptacles 737. The receptacles 737 each include a generally circular central panel 741. The central panels 741 are connected to the top panel 717 by respective tabs 743. The longitudinally inner tabs 743 are defined by respective inner longitudinal fold lines 740 extending between respective pairs of receptacles 737. The longitudinally outer tabs 743 are formed adjacent respective outer receptacles 737 and are defined by respective outer longitudinal fold lines 740 extending from ends of respective curved cut lines 739 forming the outer receptacles 737. The receptacles 737 include oblique cuts 742 extending from the curved cut lines 739 forming the central panels 741. The oblique cuts 742 form foldable flaps 744 in the top panel 717 that are adjacent the curved cut lines 739. When an interior panel 741 is raised relative to the top panel 717 by the insertion of a container C in the respective receptacle 737, a respective opening 707 is formed in the top panel 717. The foldable flaps 744 are configured to engage the underside of the flanges F of the containers C when the containers C are inserted in the receptacles 737.

The end panel 719 includes two groups of laterally-spaced, longitudinal fold lines 720 generally located at the lateral end portions of the end panel 719. Similarly, the end panel 723 includes two groups of laterally-spaced, longitudinal fold lines 724 generally located at the lateral end portions of the end panel 723. In the illustrated embodiment, each group of longitudinal fold lines 720, 724 comprises six fold lines, but each group of fold lines could be more or less than six fold lines without departing from the disclosure.

The blank 713 includes gussets 753 each comprising a first gusset panel 754 foldably connected to a respective longitudinal edge of the end panel 719 at longitudinal fold lines 757, and second gusset panel 761 foldably connected to the first gusset panel 754 at oblique fold lines 765. Each gusset panel 761 is foldably connected to a respective side panel 727, 731 at a lateral fold line 769. The blank includes gussets 755 that are similar to gussets 753 and comprise a first gusset panel 756 foldably connected to a respective longitudinal edge of the end panel 723 at longitudinal fold lines 759, and second gusset panels 763 that are foldably connected to a respective first gusset panel 756 at an oblique fold line 767. Each second gusset panel 763 is foldably connected to a respective side panel 727, 731 at a longitudinal fold line 771.

In one embodiment, the side panel 727 includes a longitudinal fold line 728 extending laterally inwardly from each of the lateral fold lines 769, 771. Similarly, the side panel 731 includes a longitudinal fold line 732 extending laterally inwardly from each of the lateral fold lines 769, 771.

Figure 24:
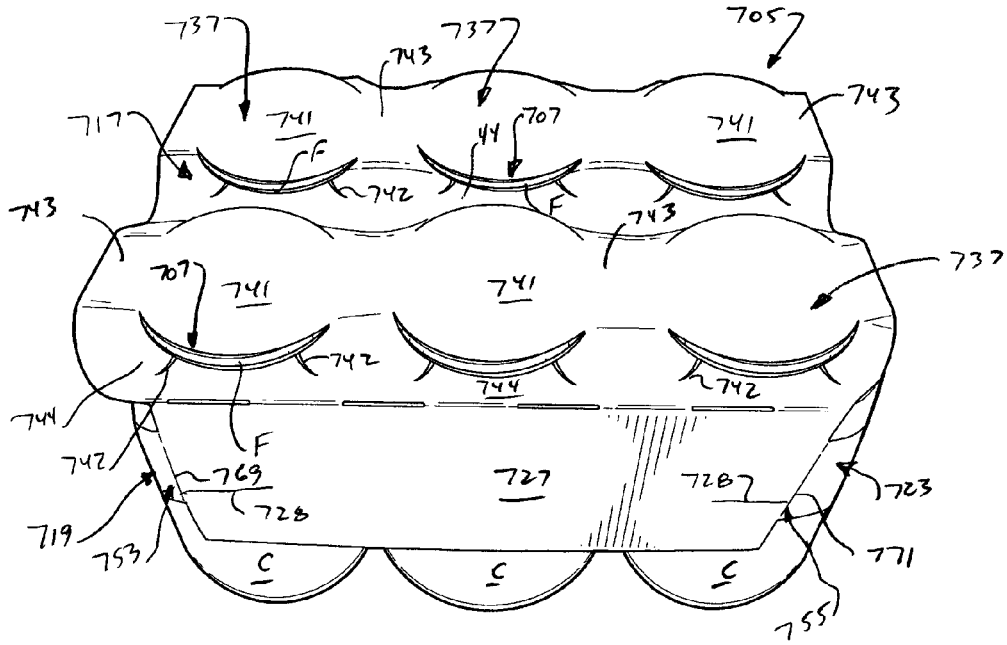
Figure 25:
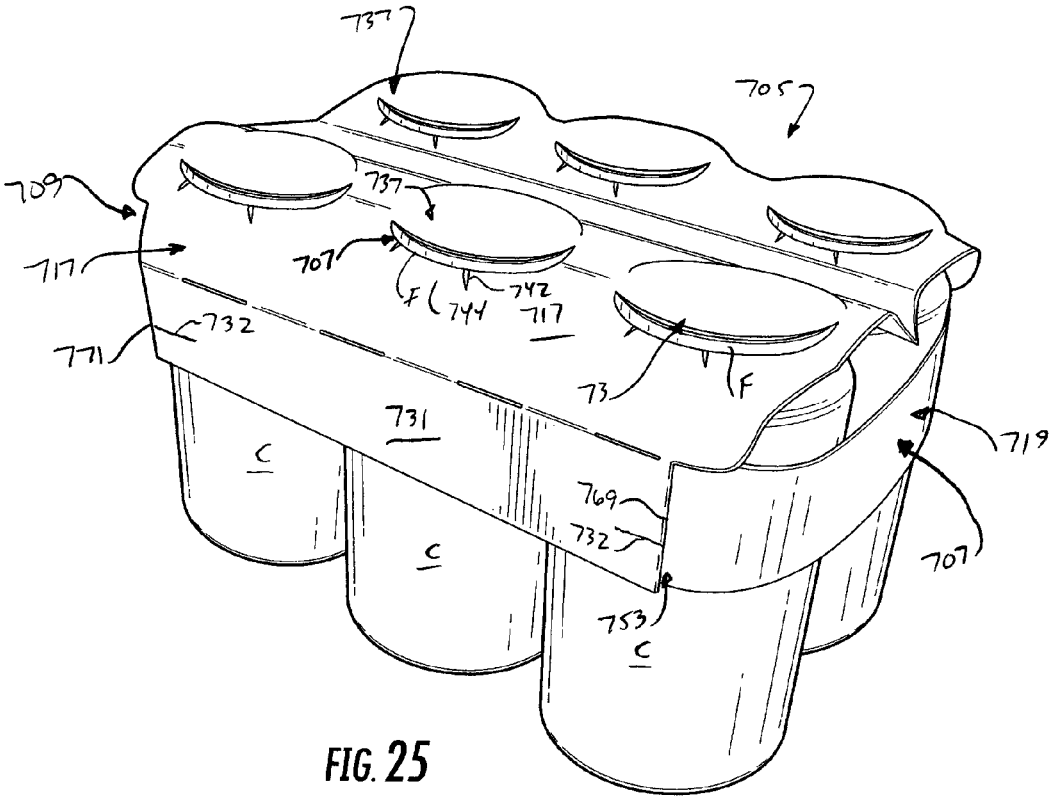
Figure 26:
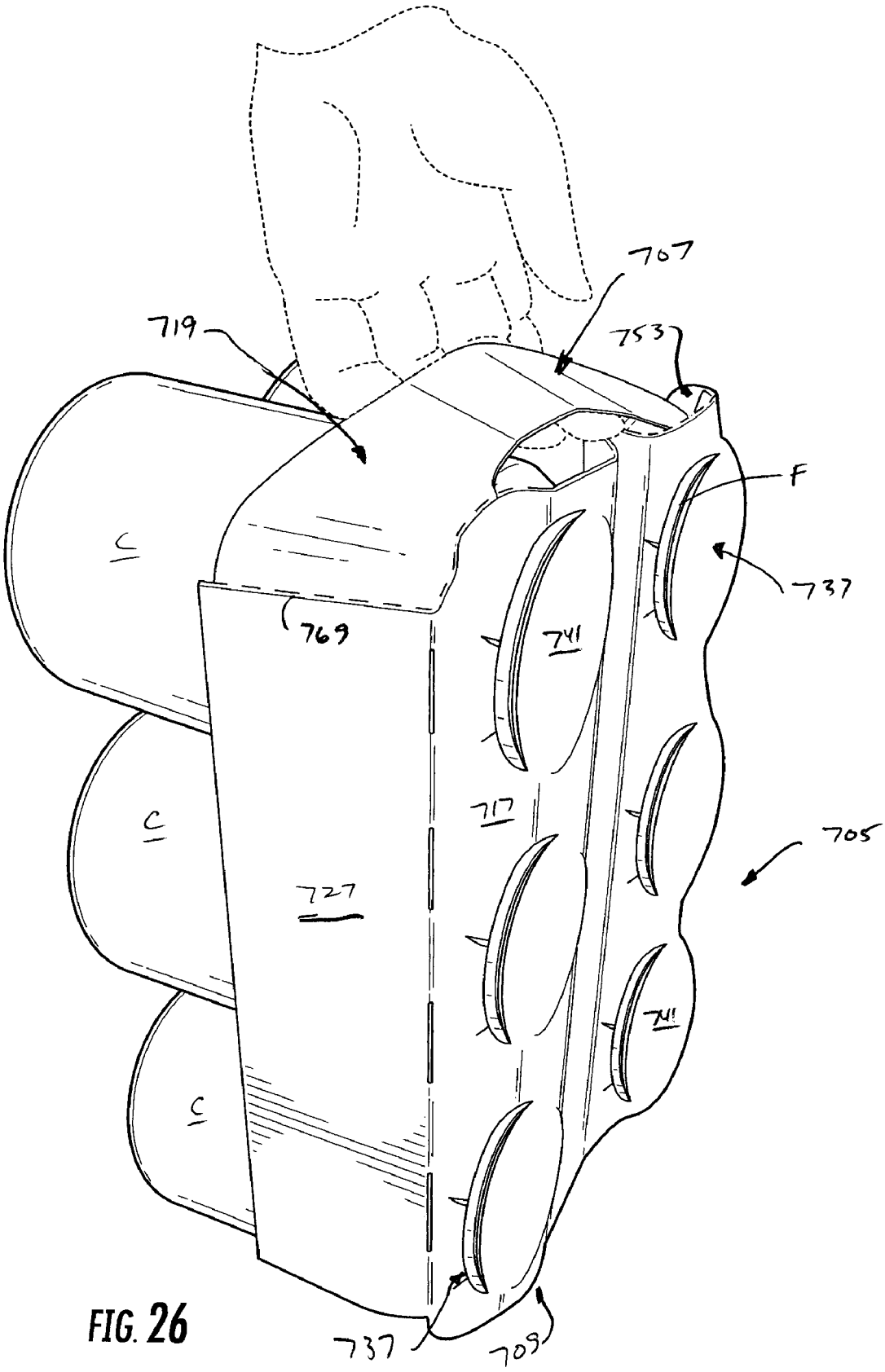

To form the package 705 shown in FIGS. 24-26, in accordance with one acceptable method, the containers C are each inserted into a respective receptacle 737. As a consequence, the top surfaces of the flanges F of the containers C contact the interior panels 741 of the receptacles 737 and raise the central panels 741, thereby forming the openings 707 in the top panel 717. The flanges F of the containers C are positioned as illustrated in FIGS. 24-26 so that the flap 744 of a respective receptacle 737 adjacent an opening 707 engages the underside of the flange F to retain the container in the package 705. Central regions of the top panel 717 between the rows of receptacles 737 are folded downwardly to form a V-shaped trench, and outer regions of the top panel 717 adjacent the side panels 727, 731 are folded to slope downwardly from the receptacles 737. The end panels 719, 723 are folded downwardly relative to the top panel 717 along respective tear lines 721, 725 and separated along the tear lines 721, 725 so that a top edge of the end panels 719, 723 is separated from the top panel 717. The side panels 727, 731 are folded downwardly at the fold lines 729, 733. The gussets 753 are folded at the oblique fold lines 765 such that the second gusset panels 761 overlie the first gusset panels 754, and the lateral fold lines 769 connecting the gusset panels 761 to respective side panels 727, 731 are positioned adjacent the end panel 719. In the same manner, the gussets 755 are folded at the oblique fold lines 767 such that the second gusset panels 763 overlie the first gusset panels 756, and the lateral fold lines 771 connecting the gusset panels 763 to respective side panels 727, 731 are positioned adjacent the end panel 723. Thus, the package 705 is formed.

In the package 705 of the embodiment of FIGS. 23-26, the end panels 719, 723 flex at the fold lines 720, 724 such that the corners or end portions of the end panels 719, 723 follow the contour of the containers C. The longitudinal fold lines 728, 732 in the side panels 727, 731 allow the end portions of the side panels 727, 731 to flex and follow the contour of the containers C. Glue or other adhesive can be applied to one or more of the panels and/or flaps of the blank 713 to secure the package 705 in the folded condition. For example, the second gusset panels 761 may be adhesively secured to the first gusset panels 754 and the second gusset panels 763 may be adhesively secured to first gusset panels 756.

As shown in FIG. 26, the end panels 719, 723 are configured to serve as handles 707, 709 for carrying the package. When the package 705 is formed, the end panels 719, 723 are separated and spaced apart from the top panel 719. The tear lines or cut lines 722, 725 and gussets 753, 755 allow the end panels 719, 723 to be positioned such that there is a space or opening (e.g., opening 724) between handles 707, 709 formed by the end panels and the top panel. The handles 707, 709 are activated by grasping the end panels 719, 723 and carrying the package. When a respective handle 707, 709 is grasped, the end panels 719, 723 can flex outwardly when the package 705 is carried.

It should be understood that the blank 713 could be otherwise shaped and/or arranged and the package 705 could have features that are otherwise shaped and/or arranged without departing from the disclosure.

The blanks according to the present disclosure can be, for example, formed from coated paperboard and similar materials. For instance, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A package for holding a plurality of containers, the package comprises:

panels that extend at least partially around an interior of the package, the panels comprise a top panel, at least one side panel foldably connected to the top panel, and at least one end panel foldably connected to the at least one side panel;

at least one feature in the top panel that receives and holds a top portion of at least one container of the plurality of containers, the at least one feature comprises an opening in the top panel and a retention feature adjacent the opening to engage at least one container of the plurality of containers to at least partially attach the at least one container to the package, wherein the at least one end panel comprises a handle for grasping and carrying the package, and the end panel comprises a plurality of curved fold lines extending across the end panel, the end panel is shaped to conform to at least one container of the plurality of containers and comprises two convex end portions, each convex end portion is shaped to conform to a respective container of the plurality of containers.

2. The package of claim 1 further comprising at least one gusset that foldably connects the at least one side panel and the at least one end panel.

3. The package of claim 2 wherein the at least one gusset comprises at least two gusset panels, the at least two gusset panels being at least partially in face-to-face contact.

4. The package of claim 1 wherein the end panel comprises a concave end portion positioned between the two convex end portions, the concave end portion is positioned between the respective containers at the end of the package and is shaped to conform to the respective containers at the end of the package.

5. The package of claim 4 wherein each convex end portion is respectively foldably connected to the top panel.

6. The package of claim 5 wherein the concave end portion is separated from the top panel by an opening in the at least one end panel.

7. The package of claim 1 wherein the at least one end panel is spaced apart from and free from foldable connection to the top panel.

8. The package of claim 1 wherein the retention feature comprises a portion of the top panel adjacent the opening, the portion of the top panel being in contact with an underside of a flange of the at least one container.

9. The package of claim 8 wherein the retention feature comprises a retention panel foldably connected to the top panel, the retention panel contacts the top of the at least one container and is spaced apart from the opening.

10. A blank for forming a package for holding a plurality of containers, the blank comprises:

panels that comprise a top panel, at least one side panel foldably connected to the top panel, and at least one end panel foldably connected to the at least one side panel, the panels are for forming an interior of the package formed from the blank;

at least one feature in the top panel that is for receiving and holding a top portion of at least one container of the plurality of containers in the package formed from the blank, the at least one feature comprises an opening in the top panel and a retention feature adjacent the opening for engaging the at least one container of the plurality of containers to at least partially attach the at least one container to the package, and the at least one end panel comprises handle features for forming a handle for grasping and carrying the package formed from the blank, a plurality of curved fold lines extending across the end panel, two end portions and an intermediate portion positioned between the two end portions, each end portion is for being shaped to conform to a respective container of the plurality of containers and the intermediate portion is for being positioned between the respective containers at the end of the package and is for being shaped to conform to the respective containers.

11. The blank of claim 10 further comprising at least one gusset that foldably connects the at least one side panel and the at least one end panel.

12. The blank of claim 11 wherein the at least one gusset comprises at least two gusset panels, the at least two gusset panels being at least partially in face-to-face contact.

13. The blank of claim 10 wherein each of the two end portions is respectively foldably connected to the top panel.

14. The blank of claim 13 wherein the intermediate portion is separated from the top panel by an opening in the at least one end panel.

15. The blank of claim 10 wherein the at least one end panel is separated from the top panel by a cut line and is free from foldable connection to the top panel.

16. The blank of claim 10 wherein the retention feature comprises a portion of the top panel adjacent the opening, the portion of the top panel is for being in contact with an underside of a flange of the at least one container.

17. The blank of claim 16 wherein the retention feature comprises a retention panel foldably connected to the top panel, the retention panel contacts the top of the at least one container in the package formed from the blank and is for being spaced apart from the opening.

18. A method of forming a package for containing a plurality of containers, the method comprising:

obtaining a blank having a top panel, at least one side panel foldably connected to the top panel, at least one end panel foldably connected to the at least one side panel, at least one feature in the top panel that comprises an opening in the top panel and a retention feature adjacent the opening, the at least one end panel comprises handle features and a plurality of curved fold lines extending across the end panel;

inserting at least a top portion of a container through the opening and engaging the top portion of the container with the retention feature to at least partially attach the container to the package;

forming a handle from the handle features; and positioning the end panel to have two convex end portions that are shaped to conform to a respective container of the plurality of containers.

19. The method of claim 18 wherein the blank further comprises at least one gusset that foldably connects the at least one side panel and the at least one end panel, the method further comprising downwardly folding the at least one side panel and the end panel relative to the top panel and activating the at least one gusset to position the at least one side panel adjacent to the end panel.

20. The method of claim 19 wherein the at least one gusset comprises at least two gusset panels, the activating the at least one gusset comprises positioning the at least two gusset panels in at least partial face-to-face contact.

21. The method of claim 18 wherein the positioning the end panel comprises positioning each of the convex end portions adjacent to a respective container of the plurality of containers.

22. The method of claim 21 wherein the end panel comprises an intermediate portion positioned between the two convex end portions, the positioning the end panel comprises positioning the intermediate portion between the respective containers.

23. The method of claim 18 wherein the retention feature comprise a portion of the top panel adjacent the opening, the inserting the at least a portion of a container comprises placing the portion of the top panel in contact with an underside of a flange of the container.

24. The method of claim 23 wherein the retention feature comprises a retention panel foldably connected to the top panel, the inserting at least a top portion of the container comprises placing the top of the container into contact with the retention panel that is spaced apart from the opening.

25. The method of claim 23 wherein the opening is a first opening, the at least one retention feature is a first retention feature, and the container is a first container, the blank comprises a second opening and a second retention feature adjacent the second opening, the method further comprises inserting at least a portion of a second container through the second opening and engaging the top portion of the second container with the second retention feature to at least partially attach the second container to the package.

26. The package of claim 1 wherein the plurality of curved fold lines extend from the top panel.

27. The package of claim 26 further comprising at least one tab foldably connected to the top panel along at least one longitudinal fold line, wherein at least one curved fold line of the plurality of curved fold lines extends from an end of the at least one longitudinal fold line.

28. The package of claim 27 wherein the at least one feature comprises at least one central panel foldably connected to the at least one tab.

29. The package of claim 1 wherein the plurality of curved fold lines comprises a first intermediate fold line and a second intermediate fold line, and the first intermediate fold line and the second intermediate fold line at least partially define a concave portion of the end panel.

30. The package of claim 29 wherein the plurality of curved fold lines comprises a first innermost fold line and a second innermost fold line extending in the concave portion, and the first innermost fold line and the second innermost fold line are joined at a respective first end point and second end point.

31. The package of claim 29 wherein the plurality of curved fold lines comprises an outer fold line, and the outer fold line and the first intermediate fold line at least partially define a convex portion of the end panel.

32. The package of claim 31 wherein the convex portion of the end panel is foldably connected to the top panel and the concave portion of the end panel is spaced apart from the top panel by an opening extending between at least a portion of the end panel and the top panel.

33. The package of claim 31 wherein:

the outer fold line is a first outer fold line and the convex portion is a first convex portion;

the plurality of curved fold lines comprises a second outer fold line; and the second outer fold line and the second intermediate fold line at least partially define a second convex portion of the end panel.

34. The package of claim 29 wherein the handle comprises the concave portion of the end panel.

35. The blank of claim 10 wherein the plurality of curved fold lines extend from the top panel.

36. The blank of claim 35 further comprising at least one tab foldably connected to the top panel along at least one longitudinal fold line, wherein at least one curved fold line of the plurality of curved fold lines extends from an end of the at least one longitudinal fold line.

37. The blank of claim 36 wherein the at least one feature comprises at least one central panel foldably connected to the at least one tab.

38. The blank of claim 10 wherein the plurality of curved fold lines comprises a first intermediate fold line and a second intermediate fold line, and the first intermediate fold line and the second intermediate fold line are for at least partially defining a concave portion of the end panel in the package formed from the blank.

39. The blank of claim 35 wherein the plurality of curved fold lines comprises a first innermost fold line and a second innermost fold line, and the first innermost fold line and the second innermost fold line are joined at a respective first end point and second end point.

40. The blank of claim 39 wherein each of the first intermediate fold line, the second intermediate fold line, the first innermost fold line, and the second innermost fold line is generally arc-shaped, and the first intermediate fold line and the first innermost fold line are generally disposed in a first orientation and the second intermediate fold line and the second innermost fold line are generally disposed in a opposing second orientation.

41. The blank of claim 39 wherein the plurality of curved fold lines comprises an outer fold line, and the outer fold line and the first intermediate fold line are for at least partially defining a convex portion of the end panel in the package formed from the blank.

42. The blank of claim 41 wherein the outer fold line extends from the top panel and the first intermediate fold line and the second intermediate fold line extend from an opening extending between at least a portion of the end panel and the top panel.

43. The blank of claim 41 wherein:

the outer fold line is a first outer fold line and the convex portion is a first convex portion;

the plurality of curved fold lines comprises a second outer fold line; and the second outer fold line and the second intermediate fold line are for at least partially defining a second convex portion of the end panel in the package formed from the blank.

44. The blank of claim 39 wherein, in the package formed from the blank, the handle comprises the concave portion of the end panel.

* * * * *